US012570913B1

(12) United States Patent
Golovko-Kamoshenkova et al.

(10) Patent No.: US 12,570,913 B1
(45) Date of Patent: Mar. 10, 2026

(54) WASTE-BASED ADDITIVE FOR SOLID FUEL AND RELATED METHODS

(71) Applicant: ROUSE ENERGY ENTERPRISES LLC, Miami, FL (US)

(72) Inventors: Oksana Golovko-Kamoshenkova, Uzhhorod (UA); Michail Sigalas, Agia Paraskevi Attikis (GR); Igor Moshensky, Tel Aviv (IL); Dmitriy Ashurov, Miami, FL (US)

(73) Assignee: ROUSE ENERGY ENTERPRISES LLC, Miami, FL (US)

( * ) Notice: Subject to any disclaimer, the term of this patent is extended or adjusted under 35 U.S.C. 154(b) by 0 days.

(21) Appl. No.: 19/039,922

(22) Filed: Jan. 29, 2025

(51) Int. Cl.
*C10L 5/48* (2006.01)
*C10L 5/44* (2006.01)

(52) U.S. Cl.
CPC ..... *C10L 5/48* (2013.01); *C10L 5/442* (2013.01); *C10L 2200/0209* (2013.01); *C10L 2200/0213* (2013.01); *C10L 2200/0218* (2013.01); *C10L 2200/0231* (2013.01); *C10L 2200/024* (2013.01); *C10L 2200/0254* (2013.01); *C10L 2200/0469* (2013.01)

(58) Field of Classification Search
CPC .... C10L 5/48; C10L 5/442; C10L 2200/0209; C10L 2200/0213; C10L 2200/0218; C10L 2200/0231; C10L 2200/024; C10L 2200/0254; C10L 2200/0469
See application file for complete search history.

(56) References Cited

U.S. PATENT DOCUMENTS

| | | | | |
|---|---|---|---|---|
| 1,924,180 | A * | 8/1933 | Cole | C10L 9/10 44/542 |
| 2,907,651 | A * | 10/1959 | Black | C22B 4/00 420/583 |
| 2006/0101713 | A1* | 5/2006 | Hahma | C06B 45/30 44/500 |
| 2009/0025285 | A1* | 1/2009 | Clark | B30B 15/308 44/597 |

FOREIGN PATENT DOCUMENTS

| | | | | |
|---|---|---|---|---|
| CN | 101440324 | * | 5/2009 | |
| CN | 101440324 | A * | 5/2009 | |
| CN | 101486935 | * | 7/2009 | |
| CN | 110499198 | * | 11/2019 | |
| DE | 2648741 | * | 5/1978 | |
| GB | 2117397 | A * | 10/1983 | C10L 9/10 |
| HU | T77281 | * | 3/1998 | |
| KR | 830002795 | * | 12/1983 | |

OTHER PUBLICATIONS https://en.wikipedia.org/wiki/Red_mud (Year: 2022).*
Thi Thuc Phuong Nguyen, Studies of Red Mud Material to use for Combustion of Vietnam Pulverized Coal, Apr. 24, 2022, Inorganics, vol. 58, 1-14 (Year: 2022).*

* cited by examiner

*Primary Examiner* — Cephia D Toomer
(74) *Attorney, Agent, or Firm* — ArentFox Schiff LLP; Michael Fainberg

(57) ABSTRACT

A fuel additive having one or more industrial and/or mining waste components, the one or more industrial waste components including one or more components generated by alumina and/or shale oil production. Also described are methods of making and methods of using the fuel additive.

17 Claims, 16 Drawing Sheets

*proximate analysis (I), ultimate analysis (II), calorific value (III), oxide analysis (IV), surface oxygen functional groups (V), SEM-EDS (VI), TG-DSC (VII), UBC (VIII), ash fusion test (IX), gas compostion (X)

Figure 4. CO emission during combustion for:
a) CA and CA+1.0AD, b) CB and CB+1.0AD Figure 5. $NO_x$ emission during combustion for:
a) CA and CA+1.0AD, b) CB and CB+1.0AD

WASTE-BASED ADDITIVE FOR SOLID FUEL AND RELATED METHODS

TECHNICAL FIELD

The present disclosure is directed to fuel additives, methods of manufacturing such fuel additives, and uses thereof.

BACKGROUND

Fuel combustion technologies present significant environmental concerns, particularly concerning the emission of particulate matter and harmful gases such as sulfur dioxide, nitrogen oxides, and carbon dioxide into the atmosphere. Additionally, the utilization of fuel in industrial boilers can detrimentally affect their efficiency and performance, stemming from issues such as slagging, fouling, and corrosion. To alleviate these challenges, one effective strategy is to introduce additives during fuel combustion to modify the reaction mechanism, thereby minimizing environmental impact and enhancing boiler performance. However, it is a challenge to provide additives that are reasonably easy to prepare, ensure stable boiler performance, are cost-efficient, and are producible on a large scale.

BRIEF SUMMARY

The present disclosure is directed to a waste-based fuel additive for reducing the production of one or more undesirable byproducts of fuel use and/or increasing fuel efficiency. According to some aspects, the fuel additive may include one or more industrial waste components as a majority component of the additive (e.g., at least, about, or exactly 50, 60, 70, 80, 90 or 100% by wt., or in an amount within a range defined by any pair of the foregoing percentages). The present disclosure is also directed to methods of making and methods of using the fuel additive disclosed herein.

The accumulation of industrial and mineral waste (mining tailings) presents a significant challenge today, not only because these materials occupy substantial land areas but also due to the toxic nature of some wastes, which require specialized storage and handling conditions. The present disclosure helps mitigate issues associated with these waste products by providing methods for transforming industrial and mineral waste into a product that, when used in conjunction with solid fuels, enhances the efficiency and environmental performance of the combustion.

To that end, in a first general aspect, the disclosure provides a fuel additive comprising one or more industrial or mining waste components, wherein the one or more industrial waste components comprise one or more components generated by alumina and/or shale oil production.

In some aspects, the one or more industrial or mining waste components comprise bauxite residue.

In some aspects, the one or more industrial or mining waste components comprise oil shale ash.

In some aspects, the one or more industrial or mining waste components comprise one or more components of mineral waste generated during the extraction of minerals such as kaolin, dolomite, halloysite, limestone, wollastonite, vermiculite, perlite, boehmite, and corundum. In some aspects, such component may comprise, e.g., oxides such as CaO, MgO, $SiO_2$, $Al_2O_3$, or any other compound(s) described herein.

In some aspects, the one or more industrial or mining waste components comprise sodium chloride.

In some aspects, the one or more industrial or mining waste components comprise cryolite.

In some aspects, the one or more industrial or mining waste components comprise bauxite residue, oil shale ash, sodium chloride, and cryolite.

In some aspects, the fuel additive further comprises one or more secondary components selected from one or more metal chlorides, one or more metal hydroxides, one or more metal oxides, or a combination thereof. In some aspects, the one or more secondary components comprise NaCl, $Ca(OH)_2$, or a combination thereof.

In some aspects, the fuel additive comprises Fe, $Fe_2O_3$, FeO, Zn, ZnO, Al, $Al_2O_3$, Ca, $Ca(OH)_2$, CaO, NaCl (e.g., 0%-33%), $SiO_2$ (e.g., 9.6%-47.4%), MgO (e.g., 5.3%-14.9%), $Al(OH)_3$, BeO, $K_2O$, $Na_2O$ (e.g., 0.4%-12.1%), BaO, $MnO_2$, $Ba(OH)_2$ (e.g., 2.3%-11.2%), $Cr_2O_3$, $Cr(OH)_3$, $ZnCl_2$ (e.g., 6.2%-19.4%), $CaCl_2$ or any combination thereof. In the case of components listed in this passage which include an exemplary concentration range, it should be understood that the concentration refers to a weight percentage compared to the total weight of the fuel additive. Moreover, any of the recited components may be present in a fuel additive according to the disclosure in an amount within any subrange contained within the respective range listed here, including any subrange defined by a pair of endpoints selected from any pair of integer percentage values contained within the respective range listed here). For example, NaCl may be present at a concentration of 1-10%, 6-17%, 7-14%, etc., and MgO may be present at 6-14%, 8-13%, etc. In some aspects, a fuel additive may comprise any combination of the components listed in this passage (e.g., at least, at most, or exactly 1, 2, 3, 4, 5, 6, 7, 8, 9, 10, 11, 12, 13, 14, 15, 16, 17, 18, 19, or 20 of the components listed in this passage). In some aspects, a fuel additive may omit, or contain no more than trace amounts of, any of the components listed in this passage (e.g., NaCl). In some aspects, a fuel additive may contain less than 1% of any of the components listed in this passage (e.g., <1% NaCl).

In some aspects, the fuel additive is provided as a powder.

In some aspects, the fuel additive has a moisture content of no more than about 10%.

In a second general aspect, the disclosure provides a fuel briquette comprising a fuel additive as described herein, and a solid fuel. A fuel briquette may comprise, e.g., a solid fuel such as a compressed block of coal dust or other combustible biomass material (e.g. charcoal, sawdust, wood chips, peat, or paper).

In some aspects, the solid fuel comprises coal.

In some aspects, the briquette comprises the fuel additive in amount between about 0.5 and 3% by mass (e.g., at least, at most, about, or exactly 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9 or 3.0%, or an amount within a range defined by endpoints selected from any of the foregoing amounts).

In a third general aspect, the disclosure provides a of making a fuel additive comprising: providing one or more industrial or mining waste components (e.g., mining tailings), and combining the one or more industrial or mining waste components with one or more secondary components. In some aspects, the one or more industrial or mining waste components comprise one or more components generated by alumina and/or shale oil production.

In some aspects of the methods described herein, the one or more industrial or mining waste components comprise bauxite residue, oil shale ash, sodium chloride, cryolite, or a combination thereof.

In some aspects of the methods described herein, the one or more secondary components are selected from one or more metal chlorides, one or more metal hydroxides, one or more metal oxides, or a combination thereof.

In some aspects of the methods described herein, such methods further comprise a drying step whereby the fuel additive is dried to produce a fuel additive having a moisture content of no more than about or exactly 1, 2, 3, 4, 5, 6, 7, 8, 9, 10, 11, 12, 13, 14, 15, 16, 17, 18, 19, or 20%, or to moisture content level within a range defined by any pair of the foregoing percentages.

In some aspects of the methods described herein, such methods further comprise a grinding step to provide a fuel additive in the form of a powder.

In a fourth general aspect, the disclosure provides a method of using a fuel additive comprising: combining a fuel additive with a fuel, and performing a process to generate energy from the fuel, optionally wherein the fuel additive comprises one or more industrial or mining waste components (e.g., one or more components generated by alumina and/or shale oil production, or present in mining tailings). In some aspects, the process to generate energy comprises heating and/or combustion of the fuel additive and the fuel. In some aspects, the fuel comprises coal. In some aspects, the fuel additive is combined with the fuel in an amount between about 0.5 and 3% by mass (e.g., at least, at most, about, or exactly 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9 or 3.0%, or an amount within a range defined by endpoints selected from any of the foregoing amounts).

DETAILED DESCRIPTION

Figure 1:
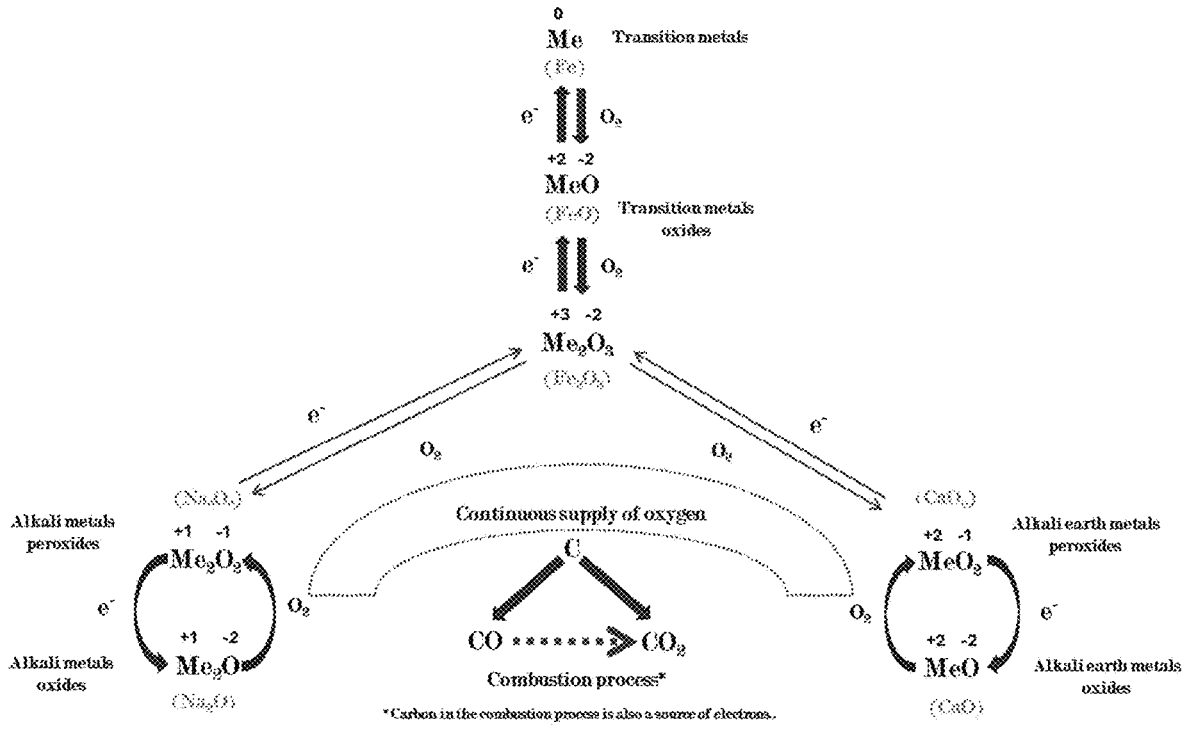
FIG. 1 shows an exemplary process by which a fuel additive may provide for an intensification of oxidizer transfer to fuel's surface due to the continuous supply of oxygen.

The present disclosure is directed to a waste-based fuel additive for reducing the production of one or more undesirable byproducts of fuel and/or for increasing fuel efficiency. According to some aspects, the fuel additive may include one or more industrial waste components. The present disclosure is also directed to methods of making and methods of using the fuel additive disclosed herein.

As used herein, the term "waste-based fuel additive" refers to a composition that, when combined with a fuel before and/or during use thereof (e.g., by pyrolysis and/or combustion), provides one or more beneficial effects, such as reducing the production of one or more undesirable byproducts of fuel use and/or increasing the efficiency of fuel. In some non-limiting examples, the fuel described herein may include a solid fuel, such wood, charcoal, peat, coal, corn, wheat, rice, rye, biomass, or a combination thereof.

Fuel Additive Compositions

The fuel additive of the present disclosure may include one or more industrial or/and mining waste components. As used herein, the term "industrial waste component" refers to the byproduct of an industrial process for generating one or more desired products and compositions provided from such byproducts. For example, the one or more industrial waste components may include one or more components generated by alumina and/or shale oil production, which in some examples may include the processing of oil shale rock by pyrolysis, hydrogenation, thermal dissolution, or a combination thereof. In some aspects, the one or more industrial waste components may include one or more components generated during the steel-making process, including steel slag generated from basic-oxygen-furnace (BOF) steelmaking, electric-arc-furnace (EAF) steelmaking, ladle furnace steel refining, or a combination thereof. In some aspects, the one or more industrial waste components may include one or more of lignite ash and fly ash. It should be understood that the one or more industrial waste components may also include one or more components provided by any of the above, such as ground granulated blast-furnace slag (GGBS or GGBFS).

As noted above, fuel additives according to the present disclosure may also (or alternatively) include one or more "mining waste components." As used herein, this term refers to the byproduct of a mining process. Mining waste components include mineral waste generated during the extraction of minerals such as kaolin, dolomite, halloysite, limestone, wollastonite, vermiculite, perlite, boehmite, corundum, and other minerals. Due to their composition, mineral wastes provide an additional source of important oxides such as CaO, MgO, $SiO_2$, and $Al_2O_3$. Furthermore, these mineral wastes often possess adsorption properties, making them possible to use as sorbents for by-products formed during the combustion of solid fuels (coal, wood, peat, biomass), including alkaline metals and their compounds, carbon dioxide ($CO_2$), carbon monoxide (CO), chlorine, sulfur and its compounds, among others.

In some non-limiting examples, the industrial waste components may include bauxite residue, oil shale ash, sodium chloride, cryolite, or a combination thereof. In some aspects, the industrial waste components may include one or more oxides. Non-limiting examples of oxides include, e.g., oxides of metals, including alkali, alkaline earth, transition, and rare earth metals, oxides of metalloids (e.g., silica), and oxides of non-metals (e.g., sulfur dioxide, phosphorus pentoxide, selenium dioxide). In some non-limiting examples, the industrial waste components may include an oxide of Ca, Fe, Si, Na, Al, Mg, K, Mn, S, Ti, P, Cr, Ba, Sr, V, Zr, Th, Se, Ce, La, Y, or Zn, or a combination thereof. Additionally or alternatively, the industrial waste components may include one or more halogens, i.e., F, Cl, Br, I, At, Ts, or a combination thereof.

Table 1 shows a non-limiting example of a fuel additive based on bauxite residue and granulated blast furnace slag, according to aspects of the present disclosure. The original composition of this fuel additive was 50% of ground granulated blast-furnace slag (GGBS), 20% Bauxite residue, 14% Sodium Chloride, 8% Calcium Hydroxide and 8% of Cryolite. An elemental analysis was conducted using three assays: ICP-OES for most cations except sodium, silicon, and the anions chlorine and fluorine. Sodium and silicon were assayed by AA; wet-chemistry methods assayed water-soluble chlorine and fluorine. The metallic elements were converted to their respective oxide forms, a standard reporting basis for coal ash and other combustion products. The oxide form was calculated based on the reported elements' elemental weights and their corresponding oxide molecular weights. Chlorine and fluorine do not form oxides; only their element concentrations are reported.

TABLE 1

An exemplary fuel additive composition according to aspects of the disclosure.

| Element | Element Wt % | Oxide Formula | Normalized Wt % (Oxide Basis) |
|---|---|---|---|
| Ca | 20.20 | CaO | 30.17 |
| Fe | 8.55 | $Fe_2O_3$ | 13.05 |
| Si | 8.35 | $SiO_2$ | 19.07 |
| Cl | 8.17 | N/A | 8.72 |
| Na | 7.90 | $Na_2O$ | 11.37 |
| F | 3.96 | N/A | 4.23 |
| Al | 3.12 | $Al_2O_3$ | 6.29 |
| Mg | 2.21 | MgO | 3.91 |
| K | 0.15 | $K_2O$ | 0.19 |
| Mn | 0.55 | $Mn_2O_3$ | 0.85 |
| S | 0.51 | $SO_2$ | 1.09 |
| Ti | 0.33 | $TiO_2$ | 0.59 |
| P | 0.095 | $P_2O5$ | 0.23 |
| Cr | 0.062 | $Cr_2O_3$ | 0.10 |

TABLE 1-continued

An exemplary fuel additive composition according to aspects of the disclosure.

| Element | Element Wt % | Oxide Formula | Normalized Wt % (Oxide Basis) |
|---|---|---|---|
| Ba | 0.034 | BaO | 0.04 |
| Sr | 0.026 | SrO | 0.03 |
| V | 0.020 | $VO_2$ | 0.03 |
| Zr | 0.012 | $ZrO_2$ | 0.02 |
| Th | 0.008 | $ThO_2$ | 0.01 |
| Se | 0.006 | $SeO_2$ | 0.01 |
| Ce | 0.004 | $CeO_2$ | 0.01 |
| La | 0.002 | $La_2O_3$ | 0.00 |
| Y | 0.001 | $Y_2O_3$ | 0.00 |
| Total | 64.27 | | 100.00 |

In some aspects, a fuel additive may comprise any combination of the elements and/or oxides listed in Table 1. Any such elements or oxides may be present in the composition at a wt. % as shown in Table 1. In some aspects, any such elements or oxides may be present in the composition at (a) a wt. % that is +1, 2, 3, 4, 5, 6, 7, 8, 9, 10, 11, 12, 13, 14, 15, 16, 17, 18, 19, or 20% compared to the listed concentration, or (b) a wt. % within a range defined by any pair of integers listed in (a), e.g., at a wt. % within 1-5%, or 5-15% of the listed concentration for any given element or oxide. The concentration of any element or oxide may be measured based upon the element wt. % or the normalized wt. % on an oxide basis, as shown in Table 1.

In some exemplary aspects, a fuel additive of the present disclosure may comprise the components shown in Table 2, or any combination thereof.

TABLE 2

A second exemplary fuel additive composition according to aspects of the disclosure.

| Element | Element Wt % | Oxide Formula | Normalized Wt % (Oxide Basis) |
|---|---|---|---|
| Ca | 24.80 | CaO | 36.12 |
| Fe | 6.82 | $Fe_2O_3$ | 10.15 |
| Si | 8.84 | $SiO_2$ | 19.69 |
| Cl | 5.58 | | 5.81 |
| Na | 6.74 | $Na_2O$ | 9.46 |
| F | 3.91 | | 4.07 |
| Al | 3.34 | $Al_2O_3$ | 6.57 |
| Mg | 2.46 | MgO | 4.25 |
| K | 0.81 | $K_2O$ | 1.02 |
| Mn | 0.06 | $Mn_2O_3$ | 0.08 |
| S | 0.94 | $SO_2$ | 1.95 |
| Ti | 0.32 | $TiO_2$ | 0.55 |
| P | 0.057 | $P_2O5$ | 0.14 |
| Cr | 0.019 | $Cr_2O_3$ | 0.03 |
| Ba | 0.013 | BaO | 0.02 |
| Sr | 0.023 | SrO | 0.03 |
| V | 0.013 | $VO_2$ | 0.02 |
| Zr | 0.011 | $ZrO_2$ | 0.02 |
| Th | 0.006 | $ThO_2$ | 0.01 |
| Se | 0.015 | $SeO_2$ | 0.02 |
| Ce | 0.003 | $CeO_2$ | 0.00 |
| La | 0.002 | $La_2O_3$ | 0.00 |
| Y | 0.001 | $Y_2O_3$ | 0.00 |
| Total | 64.77 | | 100.00 |

In some aspects, a fuel additive may comprise any combination of the elements and/or oxides listed in Table 2. Any such elements or oxides may be present in the composition at a wt. % as shown in Table 1. In some aspects, any such elements or oxides may be present in the composition at (a) a wt. % that is =1, 2, 3, 4, 5, 6, 7, 8, 9, 10, 11, 12, 13, 14, 15, 16, 17, 18, 19 or 20% compared to the listed concentration, or (b) a wt. % within a range defined by any pair of integers listed in (a), e.g., at a wt. % within 1-5%, or 5-15% of the listed concentration for any given element or oxide. The concentration of any element or oxide may be measured based upon the element wt. % or the normalized wt. % on an oxide basis, as shown in Table 2.

According to some aspects, the fuel additive of the present disclosure may include at least Fe, $Fe_2O_3$, FeO, Zn, ZnO, Al, $Al_2O_3$, Ca, $Ca(OH)_2$, CaO, NaCl (0%-33%), $SiO_2$ (9.6%-47.4%), MgO (5.3%-14.9%), $Al(OH)_3$, BeO, $K_2O$, $Na_2O$ (0.4%-12.1%), BaO, $MnO_2$, $Ba(OH)_2$ (2.3%-11.2%), $Cr_2O_3$, $Cr(OH)_3$, $ZnCl_2$ (6.2%-19.4%), $CaCl_2$) or any combination thereof. Moreover, any of the components may be present in a fuel additive according to the disclosure in an amount within any subrange contained within the respective range listed here, including any subrange defined by a pair of endpoints selected from any pair of integer percentage values contained within the respective range listed here). For example, NaCl may be present at a concentration of 0-8%, 6-17%, 7-14%, etc., and MgO may be present at 6-14%, 8-13%, etc. In some aspects, a fuel additive may comprise any combination of the components listed in this passage (e.g., at least, at most, or exactly 1, 2, 3, 4, 5, 6, 7, 8, 9, 10, 11, 12, 13, 14, 15, 16, 17, 18, 19, or 20 of the components listed in this passage).

According to some aspects, the fuel additive may have an NaCl content between about 0 and 33 wt. %, optionally between about 5.7 and 17 wt. %, optionally between about 0 and 5 wt. %. In some aspects, the NaCl content may be at least, at most, exactly, or about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, or 33 wt. %, or a wt. % within a range defined by any pair of the foregoing percentages.

According to some aspects, the fuel additive may have an Fe content between about 5.5 and 27.5 wt. %, optionally between about 6.5 and 10.5 wt. %, optionally between about 7.5 and 9.5 wt. %. In some aspects, the Fe content may be at least, at most, exactly, or about 1, 2, 3, 4, 5, 6, 7, 8, 9, 10, 11, 12, 13, 14, 15, 16, 17, 18, 19, 20, 21, 22, 23, 24, 25, 26, or 27 wt. %, or a wt. % within a range defined by any pair of the foregoing percentages.

According to some aspects, the fuel additive may have an $Fe_2O_3$ content between about 10 and 46.6 wt. %, optionally between about 11 and 15 wt. %, optionally between about 12 and 14 wt. %. In some aspects, the $Fe_2O_3$ content may be at least, at most, exactly, or about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, or 47 wt. %, or a wt. % within a range defined by any pair of the foregoing percentages.

According to some aspects, the fuel additive may have an Al content between about 0.1 and 9.6 wt. %, optionally between about 1 and 5 wt. %, optionally between about 2 and 4 wt. %. In some aspects, the Al content may be at least, at most, exactly, or about 1, 2, 3, 4, 5, 6, 7, 8, 9, 10, 11, 12, 13, 14, 15, 16, 17, 18, 19, 20, 21, 22, 23, 24, or 25 wt. %, or a wt. % within a range defined by any pair of the foregoing percentages.

According to some aspects, the fuel additive may have an $Al_2O_3$ content between about 3 and 21 wt. %, optionally between about 4 and 8 wt. %, optionally between about 5 and 7 wt. %. In some aspects, the $Al_2O_3$ content may be at least, at most, exactly, or about 1, 2, 3, 4, 5, 6, 7, 8, 9, 10, 11, 12, 13, 14, 15, 16, 17, 18, 19, 20, 21, 22, 23, 24, or 25 wt. %, or a wt. % within a range defined by any pair of the foregoing percentages.

According to some aspects, the fuel additive may have a Ca content between about 5 and 41 wt. %, optionally between about 10 and 30 wt. %, optionally between about 15 and 25 wt. %. In some aspects, the Ca content may be at least, at most, exactly, or about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, or 41 wt. %, or a wt. % within a range defined by any pair of the foregoing percentages.

According to some aspects, the fuel additive may have a CaO content between about 15 and 45 wt. %, optionally between about 20 and 40 wt. %, optionally between about 25 and 35 wt. %. In some aspects, the CaO content may be at least, at most, exactly, or about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 42, 44, or 45 wt. %, or a wt. % within a range defined by any pair of the foregoing percentages.

In some aspects, the fuel additive of the present disclosure may include one or more secondary components. As used herein, the term "secondary component" refers to a component of a fuel additive that is not the byproduct of an industrial process as described herein. In some non-limiting examples, the one or more secondary components may include one or more metal chlorides, one or more metal hydroxides, one or more metal oxides, or a combination thereof. According to some aspects, each metal chloride and/or metal hydroxide may independently include a metal selected from alkali metals, alkaline earth metals, transition metals, rare earth metals, and combinations thereof. In some non-limiting examples, the fuel additive of the present disclosure may include sodium chloride, calcium hydroxide, or a combination thereof.

According to some aspects, the fuel additive of the present disclosure may be formulated such that, when the fuel additive is combined with one or more fuels (e.g., coal, peat, wood, biofuel) before and/or during use (e.g., pyrolysis and/or combustion thereof), the production of one or more byproducts is reduced when compared with the same process without the fuel additive. In some non-limiting examples, the one or more byproducts may include particulate matter (PM), $SO_2$, $NO_x$ (i.e., NO, $NO_2$, and/or $NO_3$), $CO_2$, or any combination thereof.

In some aspects, the fuel additive of the present disclosure may have a defined moisture content, expressed as volumetric water content (%). In some non-limiting examples, the fuel additive may have a moisture content of between about 3 and 12%, optionally between about 4 and 11%, optionally between about 5 and 10%, optionally no more than about 10%, optionally no more than about 9%, optionally no more than about 8%, optionally no more than about 7%, optionally no more than about 6%, and optionally no more than about 5%.

Similarly, in some aspects, the one or more industrial waste components may have a defined moisture content, expressed as volumetric water content (%). In some non-limiting examples, the moisture content may be between about 3 and 10%, optionally between about 5 and 8%, optionally about 5%, optionally about 6%, optionally about 7%, and optionally about 8%. In some non-limiting examples, the moisture content may be achieved by a drying step, wherein the one or more industrial waste components are dried such that they have a certain moisture content as described herein.

In some aspects, the fuel additive of the present disclosure may be provided in the form of a powder. In some non-limiting examples, the powder may include particles having an average particle size between about 5 and 105 microns, optionally between about 40 and 90 microns, optionally between about 50 and 80 microns, optionally no more than about 80 microns, and optionally no more than about 70 microns. In some aspects, the fuel additive may have an average particle size of 1, 2, 3, 4, 5, 6, 7, 8, 9, 10, 11, 12, 13, 14, or 15 microns, or an average particle size within a range defined by any pair of the foregoing sizes. For example, a mineral waste component of the fuel additive may be ground to a particle size of 5-15 microns, while an industrial waste component (and accompanying components) may be ground separately to a particle size of 20 to 105 microns, and then all components may be mixed together and blended to achieve a uniform distribution within the mixture (e.g., resulting in an average particle size of 10, 20, 30, 40, 50, 60, 70, 80, 90, or 100 microns, or an average particle size within a range defined by any pair of the foregoing sizes).

Without wishing to be bound by theory, the fuel additive of the present disclosure (e.g., comprising bauxite residue containing iron and oxides thereof), may trigger chemical transformations that lead to a reduction in $NO_x$ produced by fuel combustion. Moreover, the fuel additive may include NaCl, and this component may increase retention of nitrogen in char during fuel (e.g., coal) pyrolysis. For example, NaCl may at least partially inhibit the conversion of heterocyclic nitrogen in char to tar. This inhibition may occur through the transformation of pyrrolic nitrogen to pyrrole nitrogen and amine nitrogen, as well as pyridinic nitrogen to pyridine nitrogen and nitrile nitrogen. In some aspects, use of a fuel additive according to the disclosure may result in $SO_2$ being preferentially chemisorbed on alumina contained by the fuel additive, and/or CO may be preferentially chemisorbed on iron oxide contained by the fuel additive. In this way, the production of $SO_2$ and/or $CO_2$ by fuel combustion may be reduced through use of the fuel additives described herein. It should be understood, however, that the fuel additive of the present disclosure is not necessarily limited to the foregoing mechanisms of action.

In some aspects, the fuel additive of the present disclosure may have a composition such that, when the fuel additive is combined with one or more fuels (e.g., coal) before and/or during combustion thereof, the efficiency of the fuel combustion process is increased when compared with the same combustion process without the fuel additive. In some aspects, efficiency may be increased by at least 1, 2, 3, 4, 5, 6, 7, 8, 9 or 10%, or by a percentage within a range defined by any pair of the foregoing percentages. For example, the fuel additive may affect the conversion of volatile fuel components by increasing oxidation rates and heat flow, thus reducing unburned carbon in bottom and fly ash. In this way, the fuel additive may reduce fuel consumption per unit of heat and increase equipment efficiency.

Without wishing to be bound by theory, one or more components of the fuel additive may increase the transfer of oxygen to the surface of the fuel (e.g., coal). In one non-limiting example, this transfer increase may be facilitated, at least in part, by a Na—Fe—Ca and/or a Na—Zn—Ca catalytic cascade chains. In particular, a series of oxidation-reduction reactions may promote the activation of oxygen transfer between Na and Fe and/or Zn. $Fe_2O_3$, FeO, and/or ZnO may additionally transfer oxygen received from the conversion of sodium compounds to CaO. In this way, the fuel additive may provide for an intensification of oxidizer transfer to the fuel's surface due to the continuous supply of oxygen. A schematic showing this process is provided as FIG. 1.

In some aspects, the fuel additive may comprise sodium chloride and/or calcium hydroxide. Without wishing to be bound by theory, these component(s) may, at least in part, initiate and enhance the chain process, as these components may have strong absorption features relative to oxygen, therefore becoming its carrier.

It should be understood that the fuel additive of the present disclosure is not necessarily limited to the hypothesized mechanisms of action set forth herein.

It should be understood that given the specific composition of the fuel additive of the present disclosure, a multi-functional effect may be achieved. For example, the fuel additive of the present disclosure may both reduce the amount of toxic emissions into the atmosphere by fuel use and increase the efficiency of fuel, as described herein.

Methods of Manufacturing

The present disclosure is also directed to methods of making the fuel additives disclosed herein. According to some aspects, a method may include providing one or more industrial waste components (e.g., having a defined moisture content), and combining the one or more industrial waste components with one or more secondary components as described herein.

The method further includes combining the one or more industrial waste components with one or more secondary components (e.g., one or more metal chlorides, one or more metal hydroxides, one or more metal oxides, or a combination thereof) as described herein. In some non-limiting examples, the method may include performing a drying step on the one or more industrial waste components and the one or more secondary components after combination such that the fuel additive has a defined moisture content as described herein.

The method may further include one or more grinding steps. For example, the one or more industrial waste components may be ground to a first average particle size prior to being combined with one or more secondary components. In some aspects, the one or more industrial waste components and the one or more secondary components may be ground to a second average particle size after combination. It should be understood that grinding may be achieved by any process compatible with the present disclosure, including milling.

According to some aspects, the first average particle size may be between about 100 and 170 microns, optionally between about 110 and 160 microns, optionally between about 120 and 150 microns.

According to some aspects, the second average particle size may be between about 25 and 105 microns, optionally between about 40 and 90 microns, optionally between about 50 and 80 microns, optionally no more than about 80 microns, and optionally no more than about 70 microns.

Methods of Use

The present disclosure is also directed to methods of using the fuel additives disclosed herein. The method may include, e.g., combining an amount of the fuel additive with a fuel as disclosed herein and performing a process to generate energy from the fuel, such as by pyrolysis and/or combustion of the fuel. In some aspects, the method may include providing fuel briquettes having a fuel and a fuel additive described herein, and performing a process on the briquettes to generate energy from the fuel, such as by pyrolysis and/or combustion of the fuel.

According to some aspects, the fuel additive may be combined with the fuel in an amount between about 0.5 and 3% by mass, optionally about 0.5% by mass, optionally about 1% by mass, optionally about 1.5% by mass, optionally about 2% by mass, optionally about 2.5% by mass, optionally about 3% by mass, optionally about 3.5% by mass, optionally about 4% by mass, optionally 4.5% by mass, optionally 5% by mass, optionally 5.5% by mass, optionally 6% by mass, optionally 6.5% by mass, optionally 7% by mass, or optionally 7.5% by mass. In some aspects, the fuel additive may comprise at least, at most, exactly, or about 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, or 8.0% by mass, or a percentage by mass within a range defined by any pair of the foregoing percentages. In each case, mass percentage references in this passage are made with reference to the mass of the fuel.

The present disclosure is also directed to a mixture of fuel and a fuel additive as described herein in a certain amount. In some aspects, the mixture is provided in the form of a briquette. In some aspects, the fuel additive may comprise at least, at most, exactly, or about 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, or 8.0% by mass of the mixture or briquette, or a percentage by mass within a range defined by any pair of the foregoing percentages.

While the aspects described herein have been described in conjunction with the exemplary aspects outlined above, the claims are not intended to be limited to the aspects shown herein, but are to be accorded the full scope consistent with the language of the claims, wherein reference to an element in the singular is not intended to mean "one and only one" unless specifically so stated, but rather "one or more."

Herein, the recitation of numerical ranges by endpoints includes all numbers subsumed within that range, for example, between about 1 minute and 60 minutes includes 21, 22, 23, and 24 minutes as endpoints within the specified range. Thus, for example, ranges 22-36, 25-32, 23-29, etc. are also ranges with endpoints subsumed within the range 1-60 depending on the starting materials used, temperature, specific applications, specific embodiments, or limitations of the claims if needed. The Examples and methods disclosed herein demonstrate the recited ranges subsume every point within the ranges because different synthetic products result from changing one or more reaction parameters. Further, the methods and Examples disclosed herein describe various aspects of the disclosed ranges and the effects if the ranges are changed individually or in combination with other recited ranges.

Furthermore, the terms "example" and "exemplary" are used herein to mean "serving as an example, instance, or illustration." Any aspect described herein as an "example," or as being "exemplary" is not necessarily to be construed as preferred or advantageous over other aspects. Unless specifically stated otherwise, the term "some" refers to one or more. Combinations such as "at least one of A, B, or C," "at least one of A, B, and C," and "A, B, C, or any combination thereof" include any combination of A, B, and/or C, and may include multiples of A, multiples of B, or multiples of C. Specifically, combinations such as "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C. Nothing disclosed herein is intended to be dedicated to the public regardless of whether such disclosure is explicitly recited in the claims.

As used herein, the term "about" and "approximately" are defined to being close to as understood by one of ordinary skill in the art. In one non-limiting embodiment, the term "about" and "approximately" are defined to be within 5%.

EXAMPLES

Example 1: Evaluation of an Exemplary Waste-derived Fuel Additive

This study examined the impact of a waste-derived fuel additive obtained from alumina and shale oil production in accordance with the present disclosure, on the performance of coal combustion.

Materials and Methods

Figure 2:
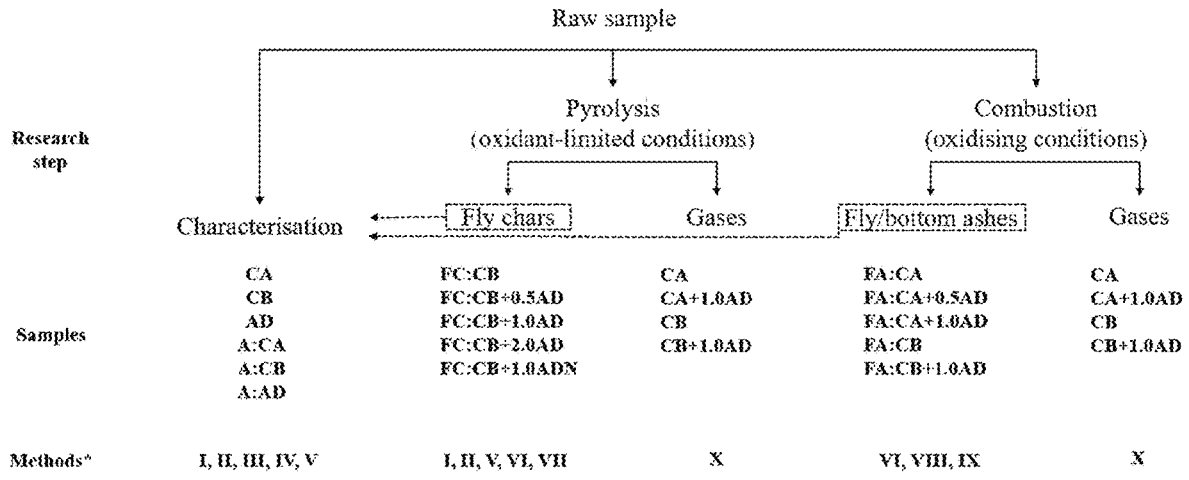
FIG. 2 shows a summary of the methods and samples used in the experiments described in Example 1.

Two types of hard bituminous coals, Coal A and Coal B, and blends containing 0.5%, 1%, and 2% by weight of the fuel additive, were evaluated in this study. The fuel additive (AD), derived from waste generated during alumina and shale oil production and mainly comprising bauxite residue, oil shale ash, cryolite, and sodium chloride, was manufactured and supplied by Dimtov Corp from Delaware (US). The coals were standard Polish ones used in the power sector. Coal A (CA) was the fuel that supplies the CHP Power plant located in Czechnica near Wrocław, while Coal B (CB) was extracted from the Janina mine. A summary of the experimental samples and methods is shown in FIG. 2.

In short, The raw samples were air-dried, pulverized to a size below 250 μm, and homogenized. The proximate analysis was performed according to ISO standardized methods for evaluating: moisture, volatiles, and ash. The ultimate analysis was conducted using Perkin Elmer CHNS 2400 following. The higher heating value (HHV) was analysed with Ika Werke C2000, according to, while the lower heating value (LHV) was determined following the eq. (1):

$$LHV=HHV-25\cdot(8.94\cdot H+M) \quad (1)$$

where: M-moisture, H-hydrogen.

The oxide analysis of the ashes was performed with a Perkin Elmer AAnlyst 400 Atomic Absorption Spectrometer, according to standard protocols. A nomenclature was adopted, according to which ash from coal A was designated as A:CA and ash from coal B as A:CB. The results obtained were supplemented with calculated indices allowing assessment of the ash's tendency to slagging and fouling, that is: the basic to acidic compounds ratio:

$$\frac{B}{A}=\frac{Fe_2O_3+CaO+MgO+Na_2O+K_2O}{SiO_2+Al_2O_3+TiO_2} \quad (2)$$

the slagging index:

$$R_s=\left(\frac{B}{A}\right)\cdot S \quad (3)$$

where: S is the share of sulphur in the coal on a dry basis; and the fouling index:

$$R_f = \left(\frac{B}{A}\right) \cdot (Na_2O + K_2O). \quad (4)$$

The closer the $R_s$ and $R_f$ parameters are to zero, the lower the risk of slagging and fouling, respectively.

The share of the surface oxygen functional groups was determined using the acid-base titration method. The total acidic groups content was calculated as a sum of the contents of carboxylic, lactone and phenolic groups.

The fly chars resulting from the pyrolysis (FC:CB, FC:CB+1.0AD and FC:CB+1.0ADN), were characterized also by means of scanning electron microscopy (SEM) coupled with energy dispersive X-ray spectroscopy (EDS) and TG coupled with differential scanning calorimetry (DSC), in addition to the proximate/ultimate analysis and functional group determination noted above. The SEM-EDS imaging was performed using a Thermo Fisher Prisma E device, while TG-DSC analyses were carried out with a Perkin Elmer Pyris Diamond. The analyzer was able to provide a continuous measurement of the weight loss and the heat flow as a function of time and/or temperature. About 10-20 milligram samples were heated with a flow of 200 $ml \cdot min^{-1}$ of carrier gas. Samples were placed in an open crucible, heated to 900° C., with a heating rate of 20° C. per minute, and maintained for 30 minutes. The whole experiment was performed in an atmosphere of nitrogen to simulate the pyrolysis process or air to simulate the combustion.

Fly ashes from the combustion process (FA:CA, FA:CA+1.0AD, FA:CB, FA:CB+1.0AD) were characterized by means of SEM-EDS imaging, the loss-on-ignition test (LOI, or unburned carbon loss UBC) and the ash fusion test (AFT). The LOI test was performed using a furnace according to known protocols. The AFT measurements were carried out by means of the Leitz heating microscope, according to known protocols. The samples were acquired from the isothermal flow reactor using removable probes. Investigated samples contained fly ash derived from Coal A (FA:CA) and blends of Coal A and 0.5%/1% by weight of additive (FA:CA+0.5AD and FA:CA+1.0AD, respectively). For each sample, the AFT test was performed under both reducing and oxidizing atmospheres.

The influence of the additive on the pyrolysis and combustion processes was studied using an isothermal flow reactor (IFR) research stand. The IFR rig enabled experiments under high-rate heating conditions of approximately $10^3$-$10^{4\circ}$ $C. \cdot s^{-1}$. It was equipped with a set of gas composition analyzers such as FTIR, Gasmet CX4000, and Ultramat23, capable of measuring $H_2O$, $NO_x$, $SO_2$, CO, $CO_2$, and $CH_4$. The mixture of pulverized fuel and carrying gas was fed to the cyclone of the burner (with an inside diameter of 38 mm) and transported by the central burner passage to the reactor's chamber. The secondary stream is supplied to the external cyclone of the burner and then to the outer ring of the burner. The rig has been described in more detail in other work.

The study of pyrolysis was conducted on samples of CB and its blend with 1% by weight of additive (CB+1.0AD). The wall temperature of the furnace was kept at 1200° C., reflecting exhaust gas temperatures of approximately 950° C. Measurements were recorded under steady-state conditions, defined by the stable composition of pyrolytic gas over at least 30 minutes. The tests were performed for different residence times of fuel particles in the furnace, resulting from varying flow rates of fuel and nitrogen. To ensure a residence time of 2 seconds, the volumetric flow rate of the carrier gas was equal to 2500 $l \cdot h^{-1}$ and the volumetric flow rate of the auxiliary gas was 3500 $l \cdot h^{-1}$. To achieve residence times of 4 and 8 seconds, the volumetric flow rates of gas streams were adjusted to 1500/2500 $l \cdot h^{-1}$ and 1000/1600 $l \cdot h^{-1}$, respectively, corresponding to a mass flow of the fuel of about 0.5 and 0.4 $kg \cdot h^{-1}$. The concentration of pulverized fuel dust was ranged between 115 and 155 $g \cdot m^{-3}$. The composition of the pyrolytic gas was measured online during each experiment, while the remaining fly char was collected by a cyclone and subsequently analyzed (samples labelled as FC:CB and FC:CB+1.0AD).

The combustion tests were performed for samples CA, CB, CA+1.0AD and CB+1.0AD. Measurements were carried out while maintaining stable process parameters such as residence time (at 4 seconds), air-fuel equivalence ratio (at 1.2), wall temperature (at 1200° C.) and the concentration of oxygen in the exhaust gas (at approximately 4%). Experiments were conducted for 6-7 hours. During the tests, the composition of exhaust gasses was recorded, and two types of ash were collected. The bottom ash was pulled down by gravitational force and descended into the container, while the fly ash passed through the cyclone into the bag. Both types of ash were analyzed using laboratory techniques listed above.

Results

The results of the proximate and ultimate analysis are listed in Table 3. There was a significant variation in moisture content among the coals, ranging from 1.8% to 10.0%, while the differences in volatile matter and ash content were comparatively smaller, ranging from 26.7% to 30.5% and 10.8% to 17.5%, respectively. In comparison to CA, the CB sample exhibited a significantly higher proportion of elemental carbon (61.7% compared to 50.0%) and sulfur (1.6% vs. 0.4%). The shares of nitrogen, hydrogen and calorific values were similar in both cases.

TABLE 3

Proximate and ultimate analysis of samples.

| Sample | M wt % ad | VM | Ash | C | H wt % db | N | S | O* | HHV MJ/kg | LHV MJ/kg |
|---|---|---|---|---|---|---|---|---|---|---|
| CA | 1.8 | 26.7 | 17.5 | 50.0 | 3.2 | 0.9 | 0.4 | 28.0 | 28.7 | 27.9 |
| CB | 10.0 | 30.5 | 10.8 | 61.7 | 3.5 | 1.2 | 1.6 | 21.2 | 27.1 | 26.1 |
| AD | <0.5 | nd | 78.6 | 10.6 | 0.2 | 0.1 | 0.7 | 9.8 | nd | nd |

where: M—moisture, VM—volatiles, C—carbon, H—hydrogen, N—nitrogen, S—sulphur, O—oxygen, ad—air-dried basis, db—dry basis, nd—no data,

*calculated by difference.

The chemical composition of coal and additive ashes was determined through standard oxide analysis, and the summarized results are presented in Table 4. Following the adopted nomenclature, ash from coal A is designated as A:CA, from coal B as A:CB, and from the additive as A:AD. The A:CA sample is rich in acidic compounds, with the combined proportion of $SiO_2$, $Al_2O_3$, and $TiO_2$ reaching 78.27%, which is 15.41% higher than that of A:CB and 14.38% higher than that of A:AD. On the other hand, samples A:CB and A:AD contain a significantly higher proportion of basic compounds compared to A:CA, with values of 37.12% and 35.78%, respectively, as opposed to 17.82% for A:CA. Interestingly, the comparison of ashes from coal A and B indicates that in the case of A:CB, the share of every basic compound ($Fe_2O_3$, CaO, MgO, $Na_2O$, and $K_2O$) was higher than in the case of A:CA. This difference in composition results in varying tendencies of the ash to slagging and fouling.

The $R_s$ factor for A:CA and A:AD is lower than 0.61, indicating a low risk of slagging for these ashes. For A:CB, the $R_s$ factor was 0.94, falling within the range of 0.61 to 0.99, suggesting a medium risk of slagging. It is important to note that the value obtained for A:CB is close to the upper limit, emphasizing the potential for more severe slagging phenomena in practice. Similarly, the magnitude of the $R_f$ factor was significantly higher for A:CB than for A:AD and A:CA. Although all results indicate a medium risk of fouling, those obtained for A:CA and A:AD are closer to the lower limit of 0.60, classifying them as low-risk materials.

TABLE 4

Oxide analysis of the ash.

| Sample | $SiO_2$ | $Al_2O_3$ | $Fe_2O_3$ | $Mn_3O_4$ | $TiO_2$ % | CaO | MgO | $Na_2O$ | $K_2O$ | $SO_3$ | B/A | $R_s$ — | $R_f$ |
|---|---|---|---|---|---|---|---|---|---|---|---|---|---|
| A:CA | 60.8 | 15.67 | 9.93 | 0.05 | 1.8 | 2 | 0.7 | 3.9 | 1.31 | 3.8 | 0.23 | 0.09 | 1.19 |
| A:CB | 44.16 | 18.12 | 19.23 | 0.04 | 0.58 | 4.55 | 2.52 | 9.01 | 1.81 | 0 | 0.59 | 0.94 | 6.39 |
| A:AD | 9.34 | 54.1 | 5.7 | 0.33 | 0.45 | 25.1 | 0.98 | 0.18 | 3.82 | 0 | 0.56 | 0.39 | 2.24 |

The surface oxygen functional groups content determined in this study is presented in Table 5 and were utilized to assess the impact of NaCl on the fate of carbon in the fuel.

TABLE 5

Surface oxygen functional groups content.

| | Carboxylic groups | Lactone groups | Phenolic groups mmol · $g^{-1}$ | Total acidic groups | Total basic groups |
|---|---|---|---|---|---|
| CA | 0.0580 | 0.2344 | 0.0316 | 0.3240 | 1.0658 |
| CB | 0.3978 | 0.1020 | 0.3182 | 0.8180 | 0.8024 |
| FC:CB | 0.0200 | 0.0464 | 0.0056 | 0.0720 | 0.7002 |
| FC:CB + 1.0AD | 0.0668 | 0.0548 | 0.0024 | 0.1240 | 0.7614 |
| FC:CB + 1.0ADN | 0.0235 | 0.0489 | 0.0058 | 0.0782 | 0.7120 |

The CB sample exhibited more than twice the content of oxygen functional groups compared to CA (0.8180 mmol·$g^{-1}$ vs. 0.3240 mmol·$g^{-1}$). Given the higher content of elemental carbon in CB than CA (61.7% vs. 50.0%), it can be concluded that the content of oxygen functional groups decreases with the increase of the coal rank. When analyzing the chemical nature of coal CB and the chars formed from it (FC:CB and FC:CB+1.0AD), it is important to note that coal pyrolysis resulted in a significant reduction in the content of oxygen functional groups. Nevertheless, it should be acknowledged that in the case of pyrolysis of the sample containing the additive (FC:CB+1.0AD), the loss of functional groups, especially the carboxylic one, was less significant than for the pyrolysis of coal alone (FC:CB).

The properties of fly ash were determined by standard AFT. The results of the measurements obtained are shown in Table 6. In the nomenclature used, the designation ST refers to shrinkage temperature, DT to deformation temperature, HT to hemisphere temperature, and FT to flow temperature.

TABLE 6

Results of the ash fusion test.

| | Reducing atmosphere | | | Oxidizing atmosphere | | |
|---|---|---|---|---|---|---|
| | FA:CA | FA:CA + 0.5AD | FA:CA + 1.0AD | FA:CA | FA:CA + 0.5AD | FA:CA + 1.0AD |
| ST ° C. | 1170 | 1190 | 1200 | 1240 | 1240 | 1250 |
| DT ° C. | 1230 | 1230 | 1230 | 1270 | 1270 | 1280 |
| HT ° C. | 1250 | 1250 | 1250 | 1290 | 1290 | 1290 |
| FT ° C. | 1420 | 1400 | 1350 | 1340 | 1400 | 1350 |

A comparison of the results obtained for fly ashes from coal A (FA:CA) with those containing 0.5% and 1.0% of the additive (FA:CA+0.5AD and FA:CA+1.0AD) indicates that the additive does not significantly affect characteristic temperatures. Although a positive effect of the additive on the ST temperature (in both atmospheres) and a negative effect on the FT temperature (only in the reducing atmosphere) can be observed, the discrepancy between the results obtained is not significant and amounts to less than 15° C. on average and 70° C. in the extreme case. The results obtained confirm that AFT results determined in reducing conditions are generally lower and thus not interchangeable with the AFTs obtained in oxidizing conditions. Interestingly, slight discrepancies in the results obtained in the two atmospheres are rather observed for materials containing small $Fe_2O_3$ proportions, whereas in the case of the A:CA sample, the share of $Fe_2O_3$ was quite significant (9.93%). It should also be borne in mind that, as the fly ashes were taken from the IFR test stand, which is characterized by significant heating rates similar to those observed in the pulverized fuel boilers, the results obtained should be close to the values describing the behaviour of ashes in real units, which may be of great practical significance.

Figure 3:
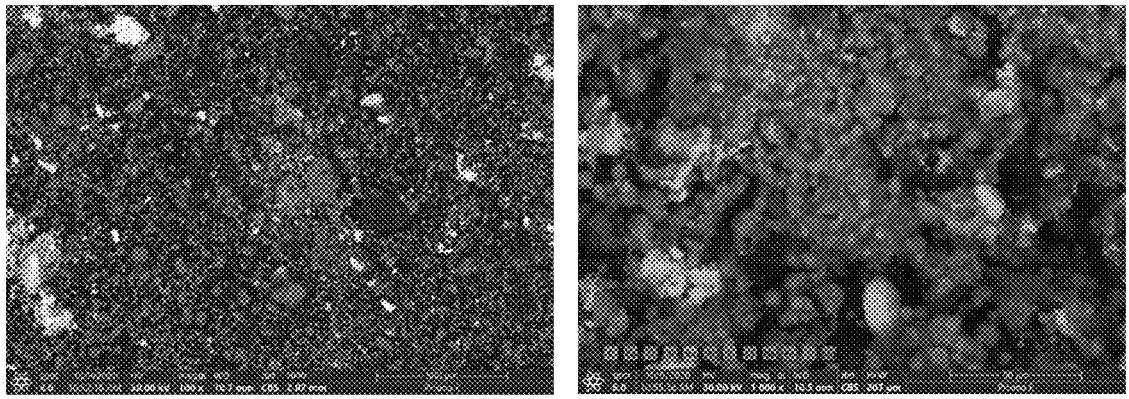
FIG. 3 shows an SEM-EDS analysis of the fuel additive discussed in Example 1.

The results of the SEM/EDS determinations may be used to explain the fate of sulfur, and shall be discussed next. However, it is notable that the SEM/EDS method was also employed for the initial determination of the additive composition. It was confirmed that the elements with the highest concentration on the catalyst surface are calcium (Ca), alumina (Al), iron (Fe), silicon (Si), and potassium (K). An example of an SEM-EDS measurement taken for an additive is shown in FIG. 3.

Experiments conducted under inert conditions indicated that the additive influenced the amount of nitrogen remaining in the fly char. As shown in Table 7, for a residence time of 2 s, the nitrogen content in the fly char was 13020 ppm (for FC:CB) and 13670 ppm (for FC:CB+1.0AD). For residence times of 4 s and 8 s, these values ranged between 13350-14510 ppm and 14120-14680 ppm, respectively.

| Sample | Residence time s | FC* % (db) | Ash % (db) | C % (daf) | H % (daf) | N ppm (daf) | S ppm (daf) | O** % (daf) |
|---|---|---|---|---|---|---|---|---|
| FC:CB | 2 | 83.7 | 16.3 | 91.28 | 600 | 13020 | 3940 | 6.97 |
| FC:CB + 1.0AD | | 83.4 | 16.6 | 91.97 | 2160 | 13670 | 5400 | 5.91 |
| FC:CB | 4 | 83.9 | 16.1 | 91.54 | 1790 | 13350 | 4290 | 6.52 |
| FC:CB + 1.0AD | | 84.1 | 15.9 | 90.49 | 2260 | 14510 | 4760 | 7.36 |
| FC:CB | 8 | 84.3 | 15.7 | 90.75 | 590 | 14120 | 2730 | 7.51 |
| FC:CB + 1.0AD | | 84.5 | 15.5 | 92.31 | 1890 | 14680 | 4260 | 5.61 |

*fixed carbon;
**by difference;
db—on dry basis;
daf—on dry ash-free basis

Table 7. Proximate and ultimate analysis of fly char from DTF.

The increased retention of nitrogen in char during coal pyrolysis may be attributed to the presence of NaCl. Prior research has indicated that sodium additives enhance nitrogen content in char by inhibiting the conversion of heterocyclic nitrogen in char to tar. This inhibition occurs through the transformation of pyrrolic nitrogen to pyrrole nitrogen and amine nitrogen, as well as pyridinic nitrogen to pyridine nitrogen and nitrile nitrogen. Moreover, NaCl may lead to the conversion of pyrrolic nitrogen to pyridinic nitrogen and pyrrolic/pyridinic nitrogen to quaternary nitrogen. It is noteworthy that a higher addition of NaCl can yield different results, reducing nitrogen in char by promoting the conversion of nitrogen to gaseous products. This happens through the transformation of pyrrolic nitrogen to $NH_3$ and pyridinic nitrogen to HCN. Importantly, the enhanced nitrogen retention in fly char does not directly impact $NO_x$ emissions during combustion. While char interacts significantly with ash and volatiles, the presence of NaCl influences the ratio between $NO_x$ precursors formed, i.e., $NH_3$ and HCN, without affecting their total quantity.

The other additive components affecting the NO reduction process are iron and its oxides present in bauxite residue. Under reducing conditions, NO reduction by CO over $Fe_2O_3$ occurs through the following reactions:

$$3CO + Fe_2O_3 \rightarrow 3CO_2 + 2Fe \tag{5}$$

$$2Fe + 3NO \rightarrow \frac{3}{2}N_2 + Fe_2O_3; \text{ and} \tag{6}$$

$$CO + NO \rightarrow CO_2 + \frac{1}{2}N_2. \tag{7}$$

The chemical reaction between $N_2O$ and CO takes place via the process:

$$CO+N_2O—CO_2+N_2 \tag{8}.$$

As eqs. (7) and (8) illustrate, the reduction of NO and $N_2O$ takes place with CO, leading to a decrease in the concentration of CO and an increase in $CO_2$ in the resulting gases. The mechanism described aligns with the results obtained in the IFR research stand (Table 8).

TABLE 8

Proximate and ultimate analysis of fly char from DTF.

| Sample | Residence time s | $\dot{m}$ kg/h | $\dot{V}_1$ l/h | $\dot{V}_2$ l/h | $H_2O$ % | $CO_2$ % | CO ppmv | $CH_4$ ppmv |
|---|---|---|---|---|---|---|---|---|
| CB | 2 | 0.7 | 2500 | 3500 | 0.99 | 0 | 28950 | 1240 |
| CB + 1.0AD | | | | | 1.09 | 0.19 | 28890 | 1210 |
| CB | 4 | 0.5 | 1500 | 2500 | 1.80 | 1.12 | 30350 | 930 |
| CB + 1.0AD | | | | | 1.88 | 1.27 | 24720 | 750 |
| CB | 8 | 0.4 | 1000 | 1600 | 2.17 | 1.52 | 48090 | 720 |
| CB + 1.0AD | | | | | 2.28 | 1.66 | 42590 | 660 |

where $\dot{m}$—the mass flow of fuel; $\dot{V}_1$—the volumetric flow of a carrier gas; $\dot{V}_2$—the volumetric flow of an auxiliary gas.

As indicated in Table 8, for residence times of 4 s and 8 s, the proportion of CO in the evolved gases was significantly lower for the CB+1.0AD than for CB alone. Specifically, it was 24720 ppm (CB+1.0AD), 30350 ppm (CB), 42590 ppm (CB+1.0AD), and 48090 ppm (CB), respectively. This trend was not fully confirmed for a residence time of 2 s, which could be attributed to the relatively low temperature reached by the fuel particles. Regardless of the residence time, the recorded concentration of $CO_2$ was higher for the CB+1.0AD experiments than for CB by approximately 1400-1900 ppm.

Figure 4:
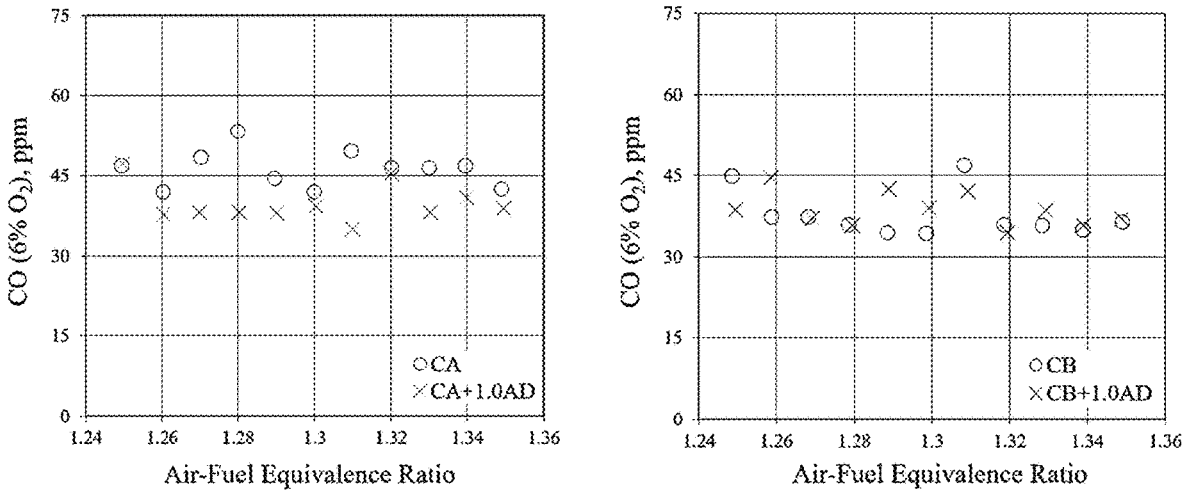
FIG. 4 shows graphs of CO emission during combustion for samples tested in Example 1, specifically: CA and CA+1.0AD (left); and CB and CB+1.0AD (right).

The mechanism described above for NO reduction in the presence of CO does not play a role in the context of combustion. Under oxidizing conditions, the air-fuel equivalence ratio was about 1.20-1.35, hence the CO concentration in the combustion chamber was very limited and reached about 35-50 ppm (FIG. 4).

Figure 5:
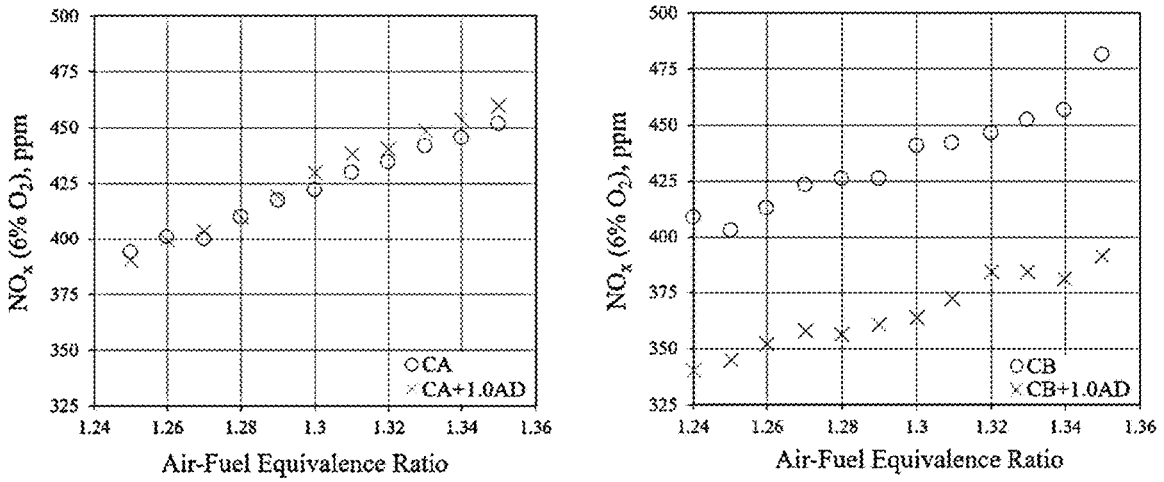
FIG. 5 shows graphs of $NO_x$ emission during combustion for samples tested in Example 1, specifically: CA and CA+1.0AD (left); and CB and CB+1.0AD (right).

Experiments under oxidizing conditions proved that the effect of the additive varied depending on the properties of the fuel used. As shown in FIG. 5, in the case of coal A, the presence of the additive appears to be irrelevant, as the recorded emission levels for both the fuel and the mixture (CA+1.0AD) were similar and amounted to 390-460 ppm. For coal B, the effect of the additive on $NO_x$ emissions appeared to be much more significant. Within the analyzed range of air-fuel equivalence ratio, $NO_x$ emissions ranged from 400 to 460 ppm (CB), and from 340 to 390 ppm (CB+1.0AD).

These findings demonstrate that under oxidizing conditions, bauxite enhances $NO_x$ conversion owing to its iron compounds. According to the outlined mechanism, $Fe^{3+}$ captures an electron, transforming into $Fe^{2+}$ while concurrently converting $NH_3$ to —$NH_2$. Subsequently, $Fe^{2+}$ donates an electron to $O_2$, reducing it into $O^{2-}$ and reverting back to $Fe^{3+}$, as expressed by the following reactions:

$$2Fe^{2+} + \frac{1}{2}O_2 \leftrightarrow 2Fe^{3+} + O^{2-} \tag{9}$$

The difference in the additive's effect on CA and CB is attributed to the influence of water vapor on the $NO_x$ reduction process. Typically, the presence of water vapor in the gaseous environment hinders $NO_x$ reduction reactions due to the $H_2O$ poisoning mechanism. However, under certain conditions, some water presence can significantly increase $NO_x$ conversion. Prior studies indicate that a share of about 2.5% of water vapor guarantees the highest $NO_x$ reduction due to changes in pore structure and the acid sites or acid strength on the sample. In the case of CB, containing 10.0% moisture (Table 3), its combustion resulted in a concentration of water vapour of approximately 2.28%. In the case of CA, with moisture content more than 5 times lower than CB (1.8%), the concentration of water vapor during combustion was very low.

Figure 6:
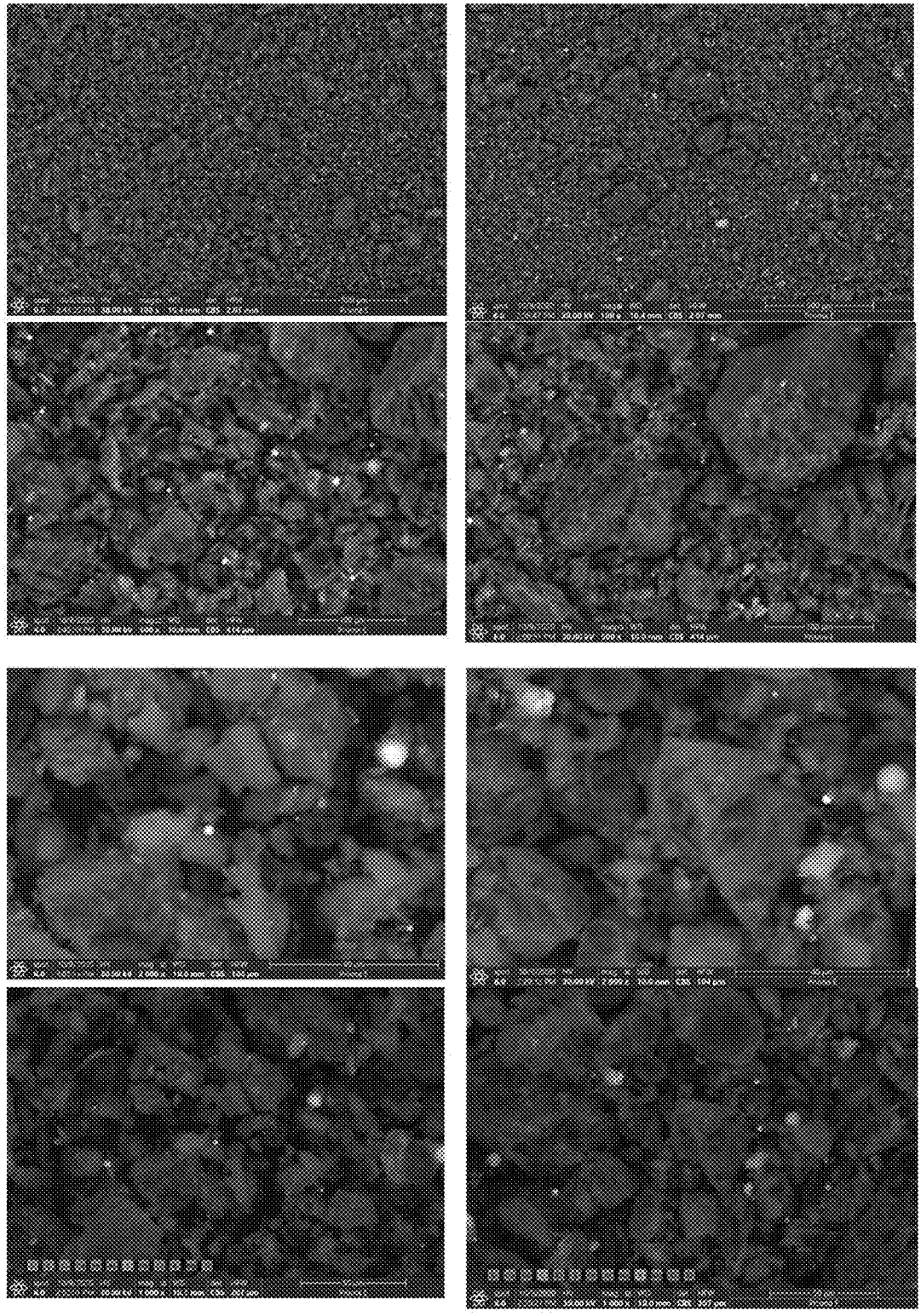
FIG. 6 shows SEM/EDS imaging of samples obtained from the pyrolysis experiments described in Example 1, specifically: FC:CB (left); and FC:CB+1.0AD (right).

As shown in Table 9, the results obtained during pyrolysis indicate that the additive increased the retention of sulfur in the fly char. For the residence time of 2 s, the sulfur content in fly char increased by 37.1%, from 3940 ppm (FC:CB) to 5400 ppm (FC:CB+1.0AD). For residence times of 4 s and 8 s, the recorded rise was about 11.0% and 56.0%, respectively. The presence of an increased proportion of sulfur in the solid reaction products was confirmed also by SEM/EDS imaging. Exemplary fly char samples taken from the reactor during pyrolysis of FC:CB and FC:CB+1.0AD are shown in FIG. 6, while the sulfur content on the surface determined by means of EDS is summarized in Table 9. The EDS analysis indicated that the FC:CB contained, on average, about 1.45% of sulfur on the surface, while for FC:CB+1.0AD this value was approximately one-third higher (1.90%).

| | S, % | F,% |
|---|---|---|
| FC:CA | nd | nd |
| FC:CA + 1.0 AD | nd | nd |
| FC:CB | 1.45 | 0.00 |
| FC:CB + 1.0 AD | 1.90 | 0.00 |
| FA:CA | 0.40 | 0.00 |
| FA:CA+1.0 AD | 1.45 | 0.00 |
| FA:CB | 1.55 | 0.00 |
| FA:CB + 1.0 AD | 2.70 | 0.00 |

Table 9. The content of sulfur and fluoride on the surface of chars and ashes derived from the IFR research stand.

Both bauxite and bauxite residue, known as red mud, exhibited good catalytic performance for $SO_2$, due to high $Al_2O_3$ and Fe content. The mechanism of the reaction is attributed to the "dual site mechanism" wherein $SO_2$ gets preferentially chemisorbed on alumina while CO is chemisorbed on iron. The reaction takes place via the following process:

$$CO + SO_2 \rightarrow CO_2 + SO \tag{10}$$

followed by eq. (11) or (12)

$$CO + SO \rightarrow \frac{1}{2}S_2 + CO_2 \tag{11}$$

$$SO \rightarrow \frac{1}{4}S_2 + \frac{1}{2}SO_2 \tag{12}$$

Interestingly, as eqs. (10) and (11) indicate, the reduction of $SO_2$ by CO can also explain, to some extent, the higher $CO_2$ concentrations in the flue gas observed in the case of pyrolysis of coal and additive blends.

Figure 7:
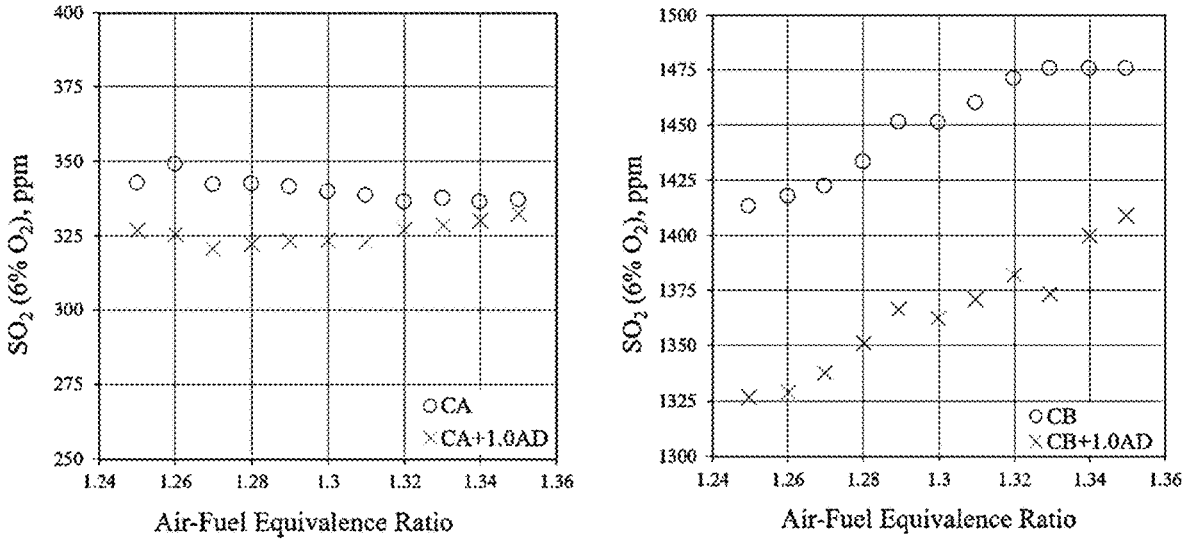
FIG. 7 shows graphs of $SO_2$ emission during combustion for samples tested in Example 1, specifically: CA and CA+1.0AD (left); and CB and CB+1.0AD (right).

Under oxidizing conditions, the effect of the additive on the fate of sulfur depended on the properties of the fuel. In the case of CA, experiments carried out on the IFR bench indicated only small differences in $SO_2$ concentration. FIG. 7 indicates an average emission of approximately 340 ppm for CA, while the value for the CA+1.0AD was around 325 ppm. Nevertheless, experiments conducted for CB highlighted the evident impact of the additive on sulfur evolution. Moreover, as FIG. 7 shows, for an air-fuel equivalence ratio ranging from 1.20 to 1.35, the $SO_2$ emissions were 1410-1475 ppm for CB and 1325-1410 ppm for CB+1.0AD.

EDS analysis of the composition of fly ash samples taken from the IFR reactor indicates that the presence of the additive resulted in better sulfur retention in the ash. According to the data presented in Table 9, the proportion of sulfur in fly ash was 0.40% for FA:CA and 1.45% for FA:CA+1.0AD, while it was 1.55% for FA:CB and 2.70% for FA:CB+1.0AD.

Similar to the analysis of nitrogen behavior presented earlier, the different compositions of the oxidizing and inert atmosphere resulted in a different transformation mechanism. When the fuel is in contact with the oxidant, the reduction in $SO_2$ emissions in gaseous form, and the concomitant increase in the share of sulfur in fly ash, is due to the binding of sulfur by calcite ($CaCO_3$) and dolomite ($CaMg(CO_3)_2$) contained in the raw coals and the OSA. The oxide analysis presented in Table 4 shows that the A:CA sample contained 2.00% calcium oxide (CaO) and 0.70% magnesium oxide (MgO), for A:CB these values were 4.55% and 2.52% respectively, and for A:AD 25.10% and 0.98%.

The presence of these compounds in the ash indicates the decomposition of the $CaCO_3$ contained in the raw materials, according to eq. 13 and the decomposition of the $CaMg(CO_3)_2$ following eq. 14 or eq. 15.

$$CaCO_3 \rightarrow CaO + CO_2 \tag{13}$$

$$CaMg(CO_3)_2 \rightarrow CaO + MgO + 2CO_2 \tag{14}$$

$$CaMg(CO_3)_2 \rightarrow CaCO_3 + MgO + CO_2 \tag{15}$$

The rate of sulfur reaction with calcite depends on, among other factors, the $CO_2$ partial pressure. If the equilibrium pressure is higher than the $CO_2$ partial pressure, calcite undergoes calcination and forms CaO and $CO_2$ following eq. (13). The CaO then reacts with $SO_2$ in a process called sulfation:

$$CaO + SO_2 + \frac{1}{2}O_2 \leftrightarrow CaSO_4 \tag{16}$$

Otherwise $CaCO_3$ reacts directly with $SO_2$:

$$CaCO_3 + SO_2 + \frac{1}{2}O_2 \leftrightarrow CaSO_4 + CO_2 \tag{17}$$

Both reaction pathways (eqs. (13) and (16)) or (eq. (17)) require the presence of oxygen, herds under inert conditions do not occur. In the case of air-fired atmospheric units, sulfur capture occurs more likely according to rapid calcination (eq. (13)) and sulfation (eq. (16)), rather than after direct reaction with calcite (eq. (17)). It is also theoretically possible for CaO to react with $SO_2$ without oxygen, according to the reaction:

$$CaO + 3CO + SO_2 \rightarrow CaS + 3CO_2 \tag{18}$$

However, prior experiments performed in similar conditions evidenced only minor amounts of CaS; hence, the significance of this reaction seems to be marginal.

The reaction of dolomite with sulphur occurs as a result of its calcination. As indicated by prior studies, at low $CO_2$ partial pressures, dolomite undergoes a "one-step" decomposition following eq. (14). The mechanism of decomposition at high partial pressures still raises some concerns, nevertheless, the one that appears to be the most widely accepted assumes that the path is described by eq. (15) and followed by eq. (13). Both pathways lead to the formation of CaO, which afterwards undergoes sulfation (eq. (16)). Otherwise if the calcination process does not take place, then $SO_2$ reacts directly with dolomite:

$$CaMg(CO_3)_2 + 2SO_2 + 9H_2O + O_2 \rightarrow$$

$$CaSO_4 \cdot 2H_2O + MgSO_4 \cdot 7H_2O + 2CO_2 \tag{19}$$

Similar to calcite, each of the reaction pathways requires oxygen, so it will not occur under inert conditions.

It can be expected that the lower sulfur content in CA compared to CB directly influences the lower $SO_2$ emissions and, consequently, a less significant additive effect. However, a second factor influencing the observed discrepancies is the presence of water vapor, of which far greater amounts were emitted during the heating of CB. As shown by prior research, the limited amount of water vapor favors the reduction of $SO_2$, among others, through the formation of sulfuric acid ($H_2SO_4$), which easily leaves the active sites. However, it should be borne in mind that an increase in the proportion of water vapor in the flue gas above a certain value will result in impaired $SO_2$ conversion, through the formation of aluminum sulphate ($Al_2(SO_4)_3$), which blocks the active sites. These observations are consistent with prior studies and prove that in an $H_2O$ atmosphere, calcination begins at a lower temperature than in dry conditions due to the adsorption of $H_2O$ on active sites.

As indicated by the proximate and ultimate analysis in Table 3, the two coals analyzed exhibited significant differences in moisture content (CA: 1.80%, CB: 10.0%). Despite this, they contained quite similar proportions of hydrogen (CA: 3.2%, CB: 3.5%). In the case of the additive, both moisture content and hydrogen content were very low, at <0.5% and 0.2%, respectively. According to the additive principle, it should be assumed that mixtures containing coals and an additive would have lower moisture and hydrogen content than raw fuels.

Table 8 shows the compositions of the pyrolytic gas resulting from the heating of coals and mixtures under inert conditions. Surprisingly, regardless of the sample residence time in the reactor, in every case, the water vapor concentration during CB+1.0AD pyrolysis was higher than for CB. For a residence time of 2 s, the recorded moisture level was 0.99% for CB and 1.09% for sample CB+1.0AD. For residence times of 4 s and 8 s, these values were 1.80% (CB) and 1.88% (CB+1.0AD) and 2.17% (CB) and 2.28% (CB+1.0AD), respectively. At first glance, the results obtained seem to stand in opposition to the information from the proximate analysis, indicating that the raw coal contains more moisture than the CB+1.0AD mixture. However, note that the recorded water vapor concentration is not only the result of the evaporation of inherent and surface moisture but may also be the result of hydrogen evolution from compounds included in the additive.

Compared to the experiments conducted for coals alone, during the pyrolysis of the CB+1.0AD sample, the higher vapor concentration was accompanied by a lower methane ($CH_4$) concentration. For the CB sample, the $CH_4$ concentration levels in the pyrolytic gas were 1240 ppm, 930 ppm, and 720 ppm (for 2, 4, and 8 s, respectively), while for CB+1.0AD these values reached 1210 ppm, 750 ppm, and 660 ppm. These results are consistent with prior studies and demonstrate that the observed differences are the result of the catalytic cracking of hydrocarbons. As shown by prior research, the iron oxide phase contained in bauxite residue exhibits activity comparable to that of an industrial nickel catalyst.

In addition to the influence of the bauxite residue contained in the additive, the water vapor in the atmosphere surrounding the fuel grains may also have had an impact on limiting the $CH_4$ concentration. According to well-established mechanisms for the transformation of hydrogen from coal, its evolution may follow one of four pathways. If no water vapor is present in the gaseous atmosphere surrounding the fuel grains, hydrogen takes the form of $CH_4$ and higher hydrocarbons (forming e.g., tar). If water vapor is present, it is mainly in the form of $H_2$. According to [100], the presence of water vapor favors the so-called steam reforming of methane as a result of the reaction:

$$CH_4+H_2O \leftrightarrow CO+3H_2 \quad (20)$$

and then through a water-gas shift reaction:

$$CO+H_2O \leftrightarrow CO_2+H_2 \quad (21)$$

or directly by direct steam reforming:

$$CH_4+2H_2O \leftrightarrow CO+4H_2 \quad (22).$$

Surprisingly, the concentration of hydrogen in the fly char samples obtained during the pyrolysis of CB+1.0AD is higher than in those obtained during the pyrolysis of CB alone. As shown in Table 9, tests carried out at the IFR bench highlighted that the share of hydrogen in FC:CB+1.0AD samples remaining in the reactor for 2 s, 4 s, and 8 s was 2160 ppm, 2260 ppm, and 1890 ppm, while for FC:CB these values reached 600 ppm, 1790 ppm, and 590 ppm. According to prior research, as a result of the catalytic cracking of hydrocarbons, the proportion of hydrogen in the solid fraction should decrease. However, in the absence of access to an oxidant, the evolved hydrogen was not oxidized but reacted secondarily with the fuel surface through hydrogenation. The above observation is confirmed by the results of the analysis of the composition of the functional groups present on the surface of the fly chars from CB and CB+1.0AD. As shown in Table 5, in the FC:CB+1.0AD sample, the content of carboxylic and lactone groups (including hydrogen in their composition) was almost twice higher than for the FC:CB material. The observation of the bonding of hydrogen atoms in the presence of bauxite, by hydrogenation, is confirmed by prior research.

Figure 8:
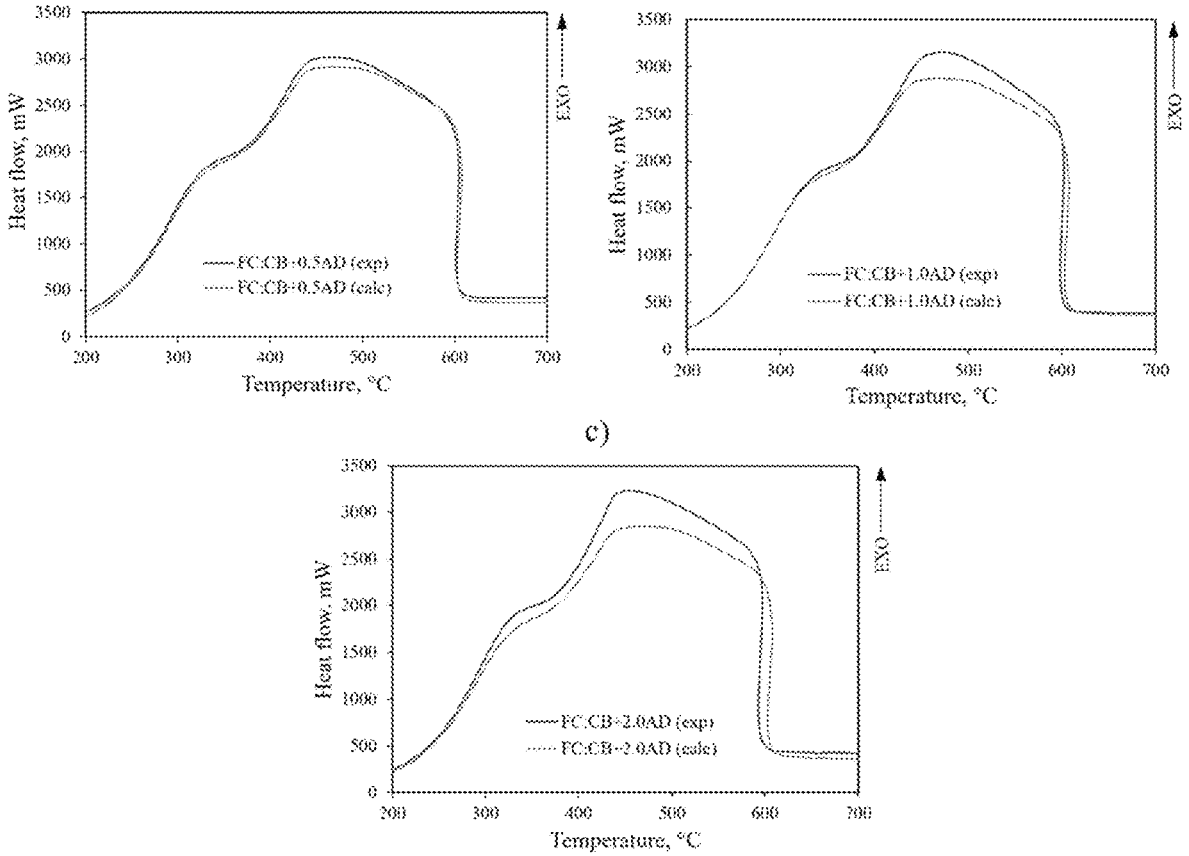
FIG. 8 shows DSC curves describing combustion of samples tested in Example 1, specifically: FC:CB+0.5AD (upper-left); FC:CB+1.0AD (upper-right); and FC:CB+2.0AD (bottom).

An important issue is whether and how the phenomena related to hydrogen evolution observed during pyrolysis affect the combustion process. Under oxidizing conditions, hydrogen, methane, tars, and fly char undergo combustion, making it challenging to directly capture the mechanism of the transformation. Nevertheless, the use of DSC analyses seems to indirectly indicate the fate of hydrogen. The actual heat signal recorded during the combustion of FC:CB+0.5AD, FC:CB+1.0AD, or FC:CB+2.0AD was substantially higher than that calculated according to the additivity principle (see FIG. 8). Significant heat fluxes were recorded, especially at temperatures up to 400-600° C., clearly indicating enhanced oxidation of highly calorific compounds, including those containing hydrogen and carbon, occurred in the presence of the additive. Although the presence of an oxidant theoretically does not necessarily limit the steam reforming reaction and may even boost its effect, analyzing the DSC data describing the experiments carried out revealed no thermal signals indicative of endothermic reactions at high temperatures. Hence, this seems to exclude the possibility of reactions described by eq. (20) and eq. (22) playing a significant role.

As noted above, experiments carried out under inert conditions demonstrated a significant effect of the additive on the speciation of carbon in the pyrolysis gas. Table 8 shows lower concentrations of CO and $CH_4$ and higher concentrations of $CO_2$ during the pyrolysis of CB+1.0AD compared to CB. The decrease in CO and the increase in $CO_2$ are consequences of the reduction of NO by CO over $Fe_2O_3$, as described in the mechanisms in eqs. (5-8) and the dual-site mechanism (eqs. (10-12)), where $SO_2$ preferentially chemisorbs on alumina, while CO chemisorbs on iron. The reduced $CH_4$ concentration resulted from the catalytic cracking of hydrocarbons and/or steam reforming of methane.

From a practical standpoint, the fate of carbon is crucial, among other factors, for minimizing the UBC. This loss is responsible for increased fuel demand in the boiler and elevated dust emissions from combustion processes. Table 10 presents the levels of UBC determined in fly and bottom ash samples from experiments conducted under oxidizing conditions.

TABLE 10

Unburned carbon loss determined for ashes derived during combustion

| | UBC % | |
|---|---|---|
| | Fly Ash | Bottom Ash |
| CA | 15.5 | nd |
| CA + 1.0AD | 7.4 | nd |
| CB | 10.2 | 11.5 |
| CB + 1.0AD | 5.4 | 5.3 |

In the case of CA and CB coals, the UBC levels in fly ash were 15.5% and 10.2%, while for CA+1.0AD and CB+1.0AD blends, these figures were 7.4% and 5.4%, respectively. The analysis of UBC in bottom ash indicated values of 11.5% for CB and 5.3% for CB+1.0AD. Although the measured UBC levels were higher than those typically found in actual coal-fired boilers, and specific values should not be directly attributed, the observed effect of the additive on the amount of unburned coal is significant. In each case, the presence of the additive in the mixture led to a reduction in UBC, both in fly ash and bottom ash, by approximately 50%. It is reasonable to assume that a similar level of reduction can be achieved on a real scale.

Figure 9:
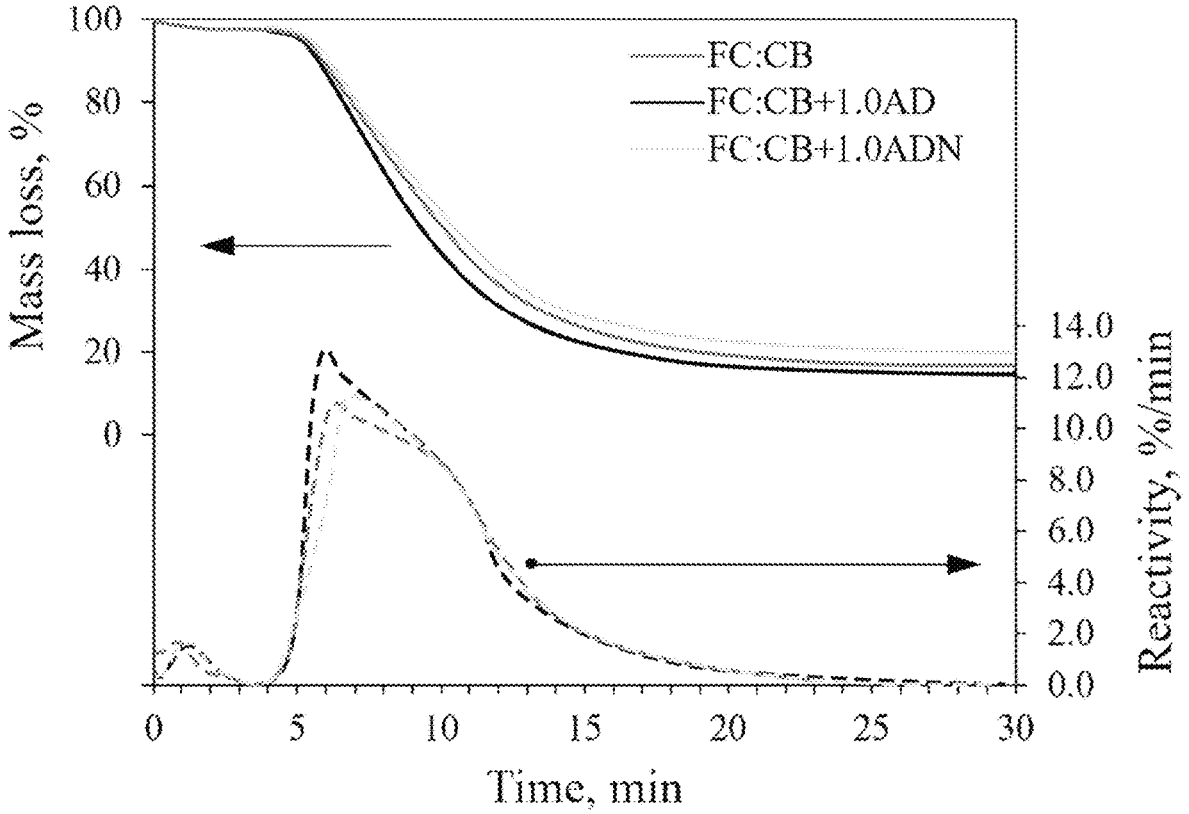
FIG. 9 is a graph showing data relating to Example 1, particularly a reactivity analysis of the char produced by heating CB (FC:CB), the char produced by heating a mixture of CB and the additive (FC:CB+1.0AD), and the char produced by re-heating FC:CB with an additive (FC:CB+1.0ADN).
Figure 10:
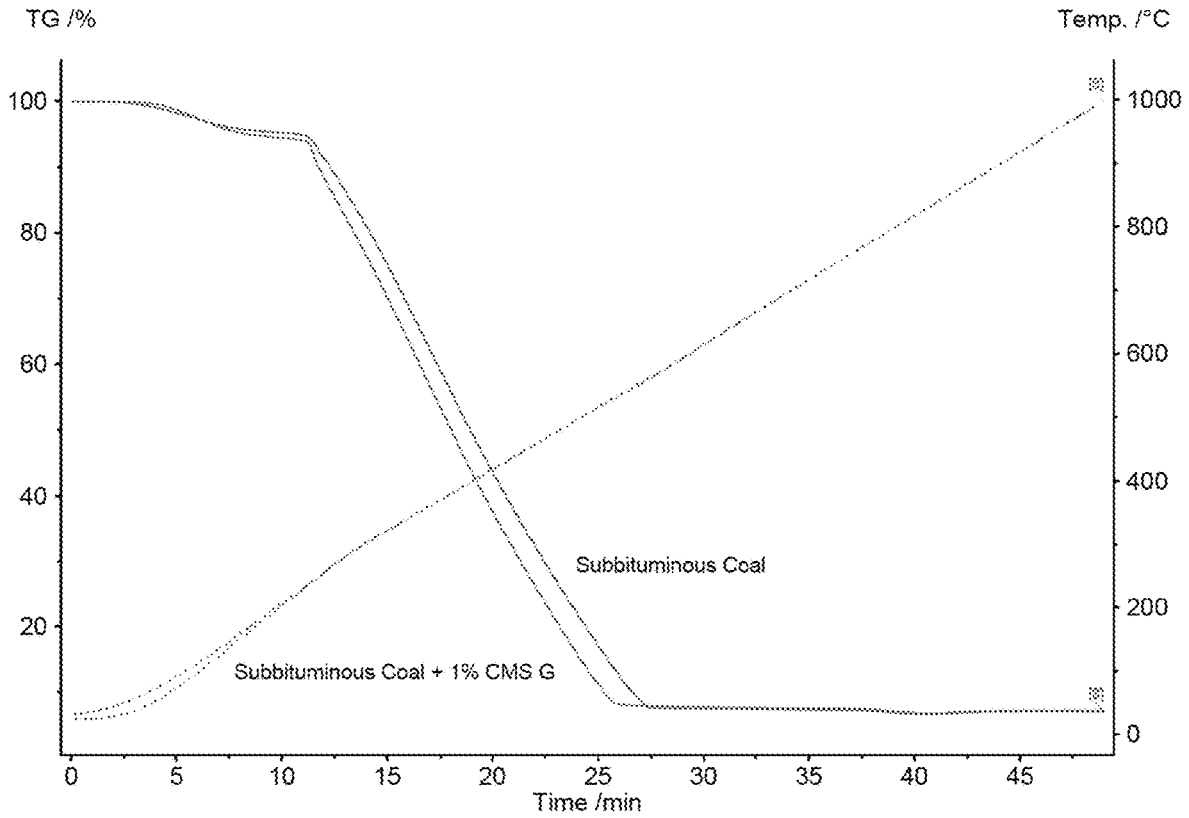
FIG. 10 is a graph showing data relating to Example 2, particularly the loss in weight for subbituminous coal and 1% by wt. of a first fuel additive according to the disclosure.
Figure 11:
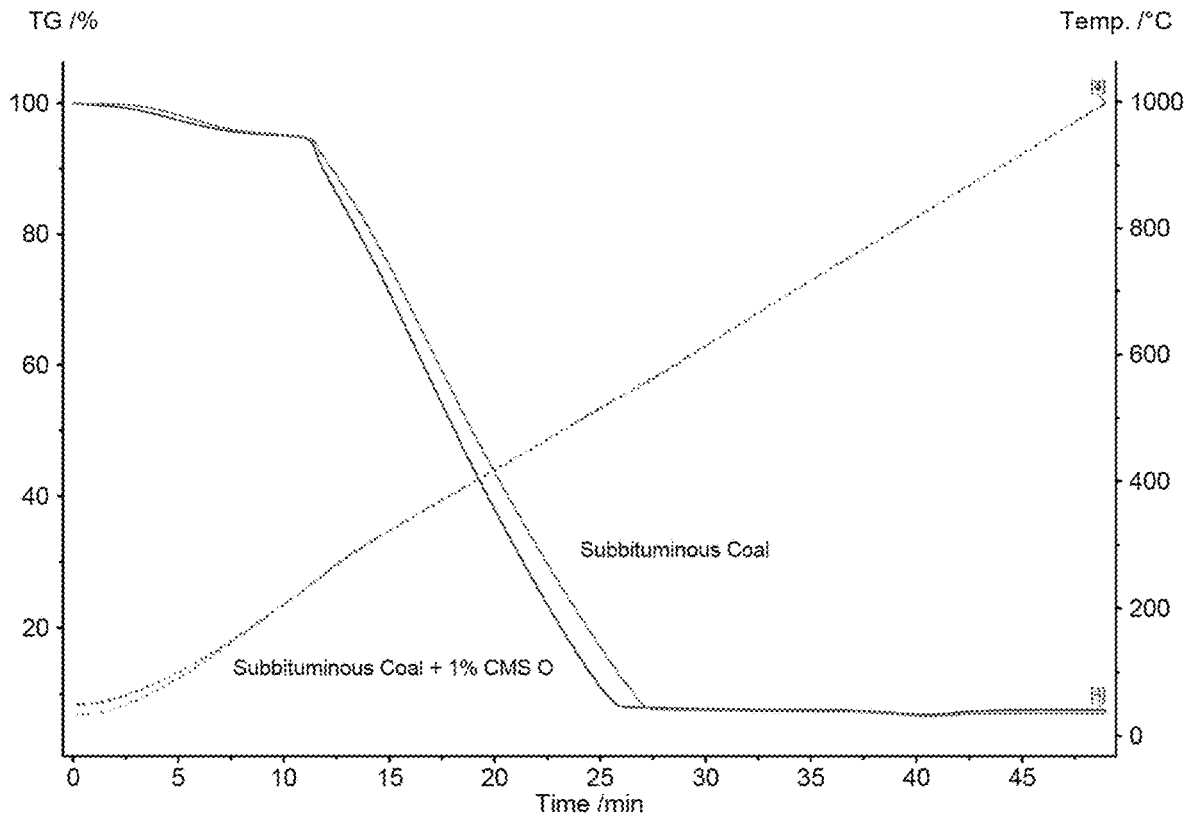
FIG. 11 is a graph showing data relating to Example 2, particularly the loss in weight for subbituminous coal and 1% by wt. of a second fuel additive according to the disclosure.
Figure 12:
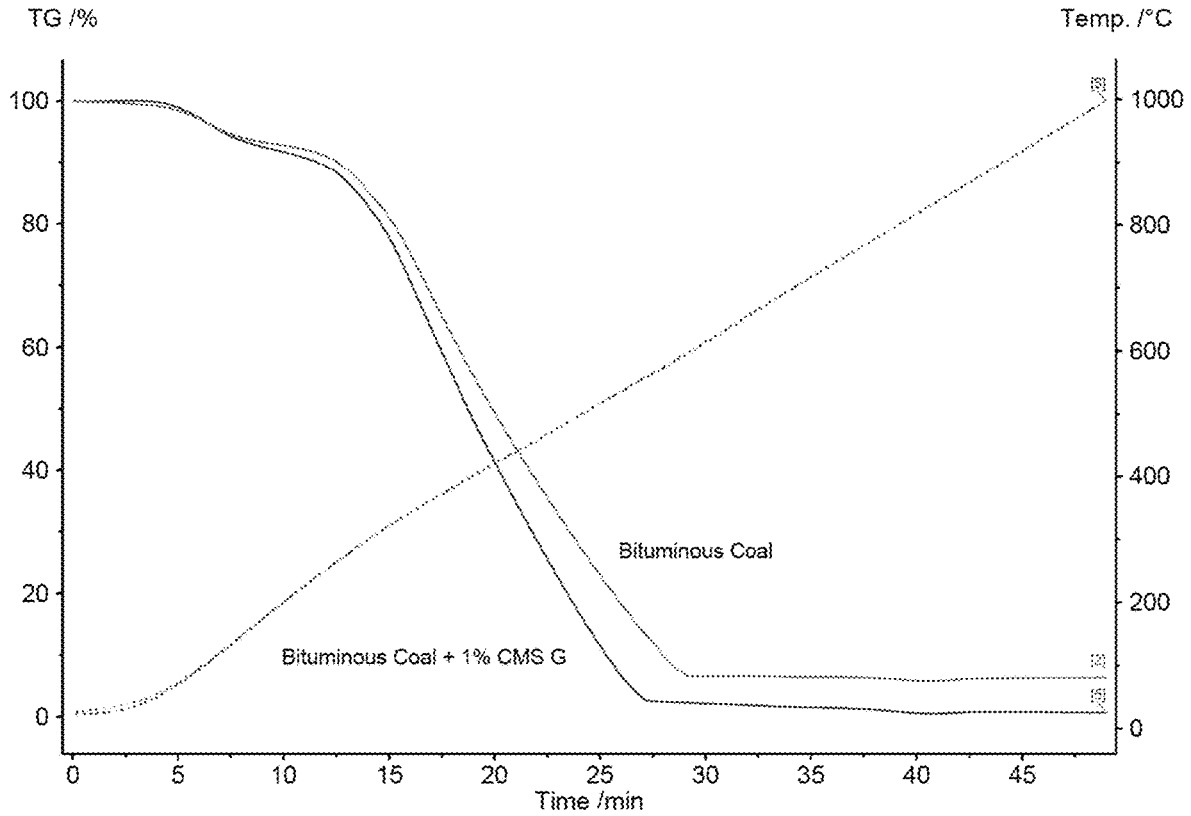
FIG. 12 is a graph showing data relating to Example 2, particularly the loss in weight for bituminous coal and 1% by wt. of a first fuel additive according to the disclosure.
Figure 13:
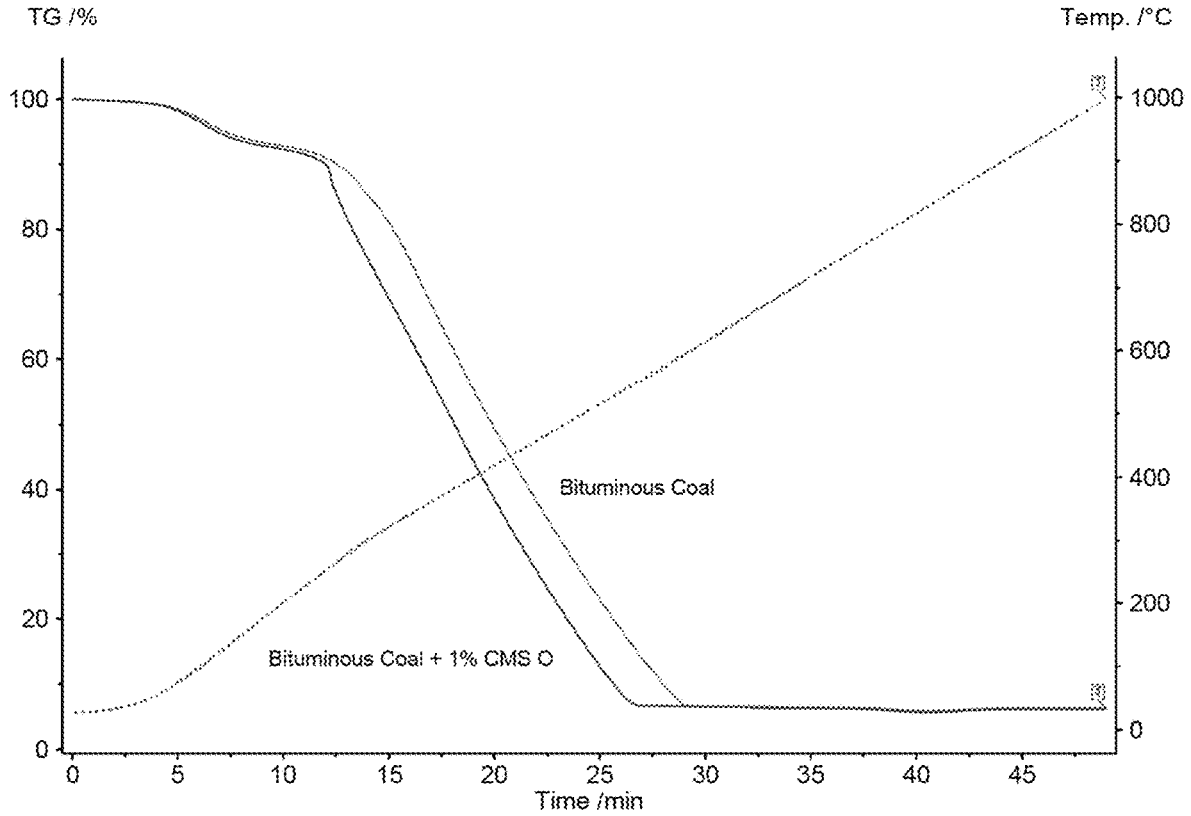
FIG. 13 is a graph showing data relating to Example 2, particularly the loss in weight for bituminous coal and 1% by wt. of a second fuel additive according to the disclosure.
Figure 14:
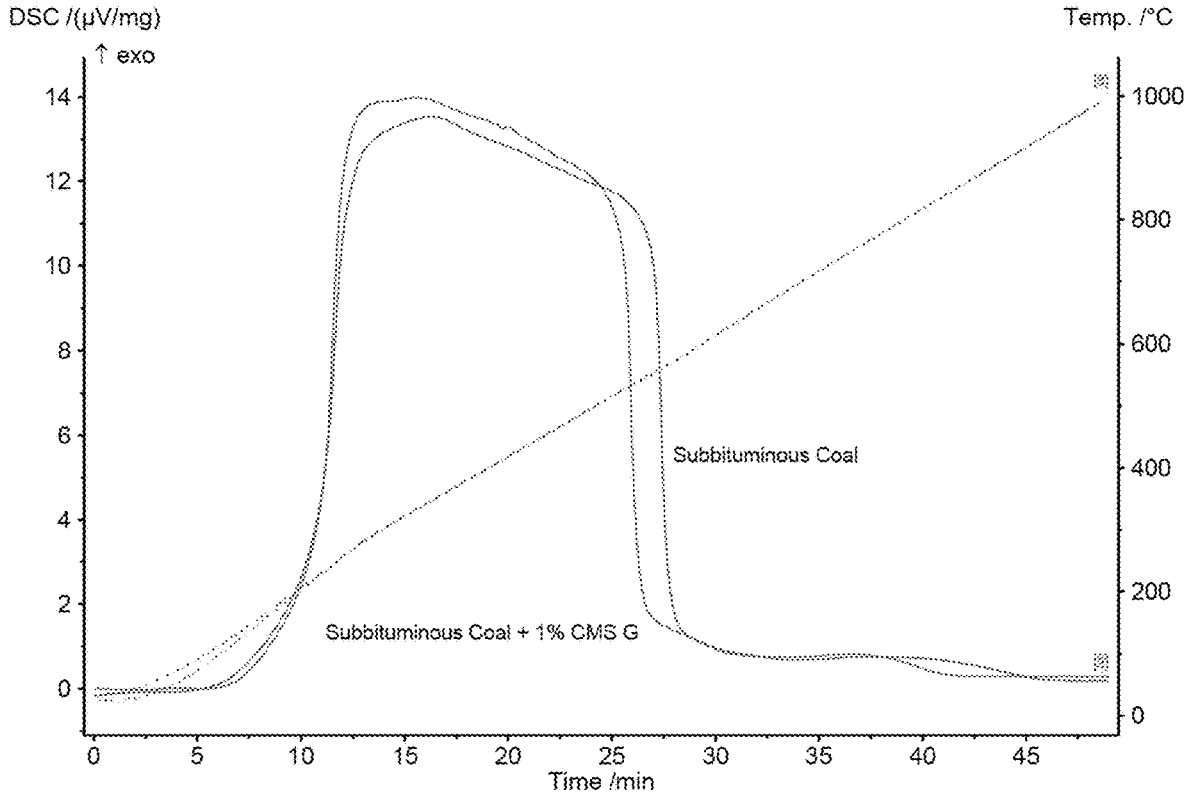
FIG. 14 is a graph showing data relating to Example 2, particularly the heat flow for subbituminous coal and 1% by wt. of a first fuel additive according to the disclosure.
Figure 15:
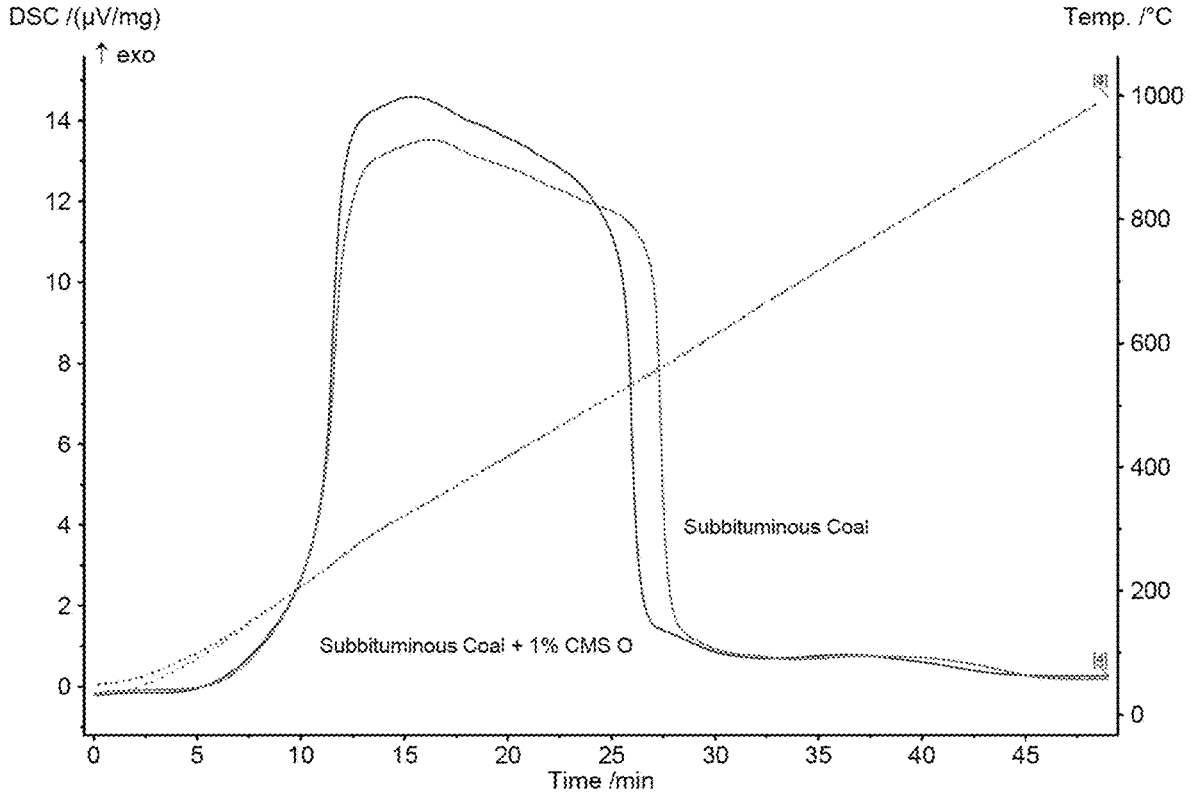
FIG. 15 is a graph showing data relating to Example 2, particularly the heat flow for subbituminous coal and 1% by wt. of a second fuel additive according to the disclosure.
Figure 16:
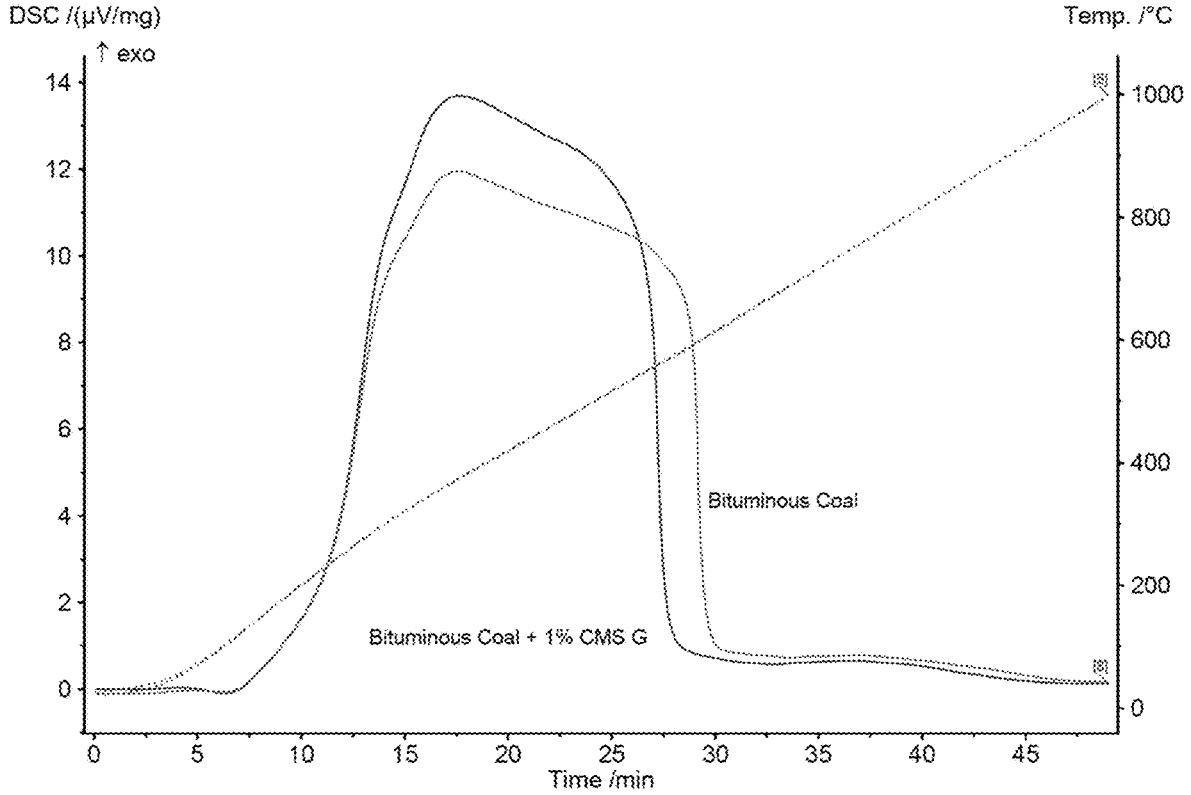
FIG. 16 is a graph showing data relating to Example 2, particularly the loss in weight for bituminous coal and 1% by wt. of a first fuel additive according to the disclosure.
Figure 17:
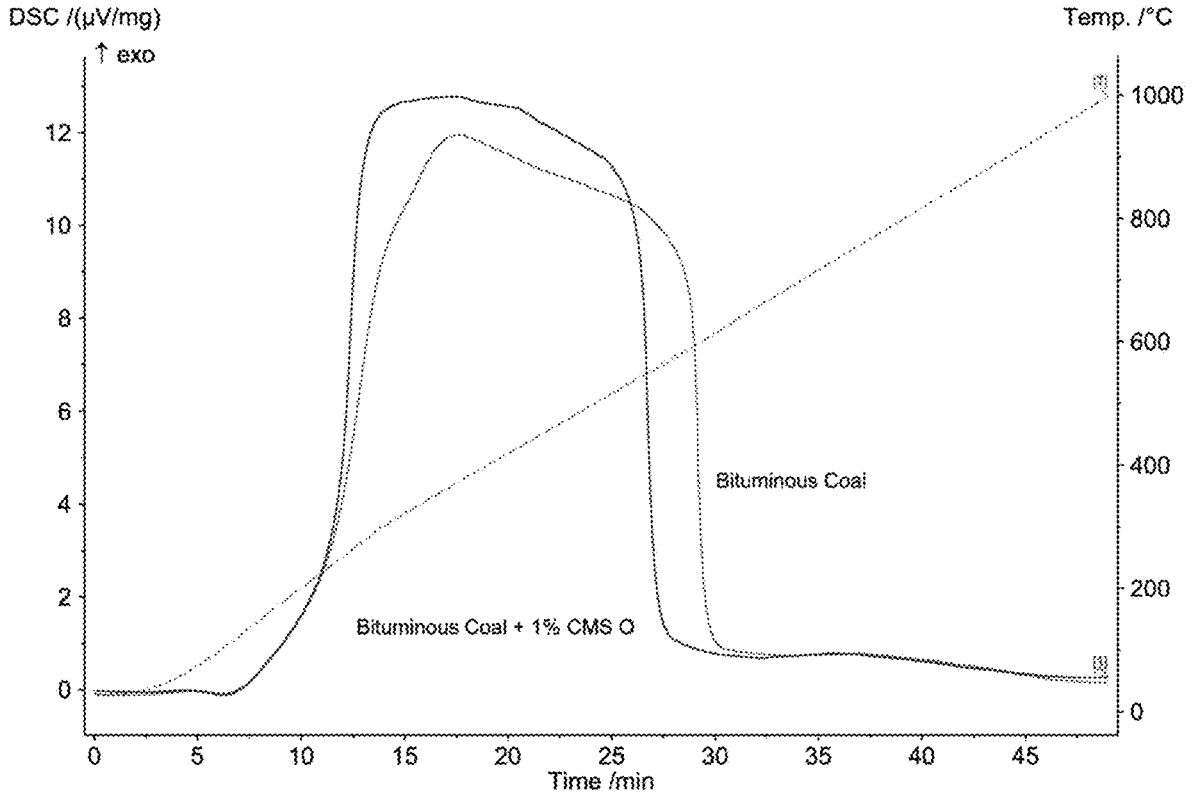
FIG. 17 is a graph showing data relating to Example 2, particularly the loss in weight for bituminous coal and 1% by wt. of a second fuel additive according to the disclosure.

To understand how and at which stage of the combustion process the additive led to a reduction in UBC, reactivity studies were carried out on fly char samples of CB extracted from the IFR reactor. FIG. 9 shows the reactivity analysis of the char produced by heating CB (FC:CB), the char produced by heating a mixture of CB and the additive (FC:CB+1.0AD), and the char produced by re-heating FC:CB with an additive (FC:CB+1.0ADN).

The results illustrate that FC:CB+1.0AD was the most reactive, with a maximal reactivity of 13.05%. $min^{-1}$. Samples FC:CB+1.0ADN and FC:CB were significantly less reactive (11.21%·min-1 and 10.94%. $min^{-1}$, respectively). Comparing the reactivity of the samples with data in Table 10, it should be noted that the reactivity of the char seems to be correlated with the level of UBC. Similar observations were presented in prior studies. As evidenced, the additive strongly increased reactivity when loaded into the coal, while when loaded into the char, its effect was slight. This indicates that the key stage for the reactivity of the char appears to be pyrolysis. Without being bound by a theory, it is believed that the process conditions in the IFR reactor intensified the release of the chloride contained in NaCl, in the form of HCl, as a result of minimizing the volatile-char interaction. Thus, sodium loaded into the coal becomes an active catalyst for the gasification of the char, increasing its reactivity. When the additive was blended directly with the char, its effect on the reactivity was much lower, as chloride remained bound to sodium in the form of NaCl, preventing it from becoming an active catalyst.

Interestingly, the content of oxygen acidic and basic functional groups decreases in the direction FC:CB+1.0AD<FC:CB+1.0ADN<FC:CB and is proportional to the char reactivity, confirming observations presented in prior research.

As discussed above, the utilization of the additive brings about several beneficial changes in the pyrolysis and combustion mechanism, including the reduction of $NO_x$ and $SO_2$ emissions and a decrease in the level of UBC. However, the additive also contains compounds in its composition, the presence of which can lead to undesirable phenomena associated with the emission of environmentally hazardous compounds or damage to the boiler.

The presence of cryolite in the additive can cause the formation of toxic hydrogen fluoride (HF). While fluorides generally exhibit melting points above 1000° C., some of them may show the presence of eutectic points melting at lower temperatures when combined with NaCl. This combination may release toxic hydrogen fluoride (HF) at temperatures as low as approximately 600-700° C. This observation seems to be confirmed by the SEM-EDS studies carried out, as Table 9 illustrates no fluorine was found on the surface of either fly chars or fly ashes.

According to the Best Available Techniques (BAT) conclusions known in the art, the emission limits for hydrogen fluoride (HF) in the industry sector have been tightened. This necessitates strict controls on the emission levels of this pollutant and mandates the use of a flue gas cleaning system if the permissible standards are exceeded. Moreover, as outlined in prior research, the presence of fluorine has the potential to lower the melting point of ash, increasing the risk of slagging and fouling in the boiler. However, the determination of characteristic ash melting temperatures, as shown in Table 6, did not confirm a significant increase in the risk of slagging and fouling. As described above, although the additive caused an unfavorable reduction in ash flow temperature (FT) by 70° C. (in a nitrogen atmosphere), it had no significant effect on shrinkage temperature (ST), deformation temperature (DT), or hemisphere temperature (HT) in either a neutral or oxidizing atmosphere.

In addition to fluorine, the introduction of chlorine into the boiler poses certain risks, particularly concerning corrosion. This concern becomes more pronounced in the context of biomass combustion, given that these fuels generally contain higher chlorine levels than coal. However, supplying NaCl to a combustion chamber where $SO_2$, $O_2$, and $H_2O$ are present will result in the formation of HCl through the sulphation of NaCl:

$$NaCl + \frac{1}{2}SO_2 + \frac{1}{4}O_2 + \frac{1}{2}H_2O \rightarrow HCl + \frac{1}{2}Na_2SO_4 \quad (23)$$

As mentioned earlier, the outcome of the aforementioned reaction is HCl, a gas harmful to human health, and subject to heightened emission limits as outlined in prior studies.

CONCLUSIONS

This set of experiments investigated the impact of a waste-derived additive on combustion performance, and analyzed the effects of individual additive components and the additive as a whole under both oxidant-limited and oxidizing conditions.

When examining the influence of the separate additive components in an oxidant-limited atmosphere, it is important to highlight the positive effects attributed to the presence of bauxite residue. These effects include the reduction of NO emissions, increased retention of sulfur in fly char (from 2730-4290 ppm to 4260-5400 ppm), catalytic cracking of hydrocarbons (resulting in a drop in $CH_4$ concentration from 930 ppmv to 750 ppmv under optimal conditions), and hydrogenation of char (with levels increasing from 600 ppm to 2160 ppm). Under oxidizing conditions, the impact of bauxite residue is mainly associated with enhanced $NO_x$ conversion, reducing concentrations from 400-460 ppm to 340-390 ppm. Oil shale ash's presence is more pronounced in oxidizing conditions, leading to reduced $SO_2$ emissions through increased sulfur retention by calcite and dolomite (from 1410-1475 ppm to 1325-1410 ppm). The addition of sodium chloride positively affects nitrogen retention in char under oxidant-limited conditions and cuts unburned carbon loss by half in an oxidizing atmosphere. Cryolite increases HF emissions, although experimental evidence did not confirm its impact on raising the risk of slagging and fouling.

The results of this set of experiments emphasize the significant influence of moisture on thermochemical processes, underscoring that a specific amount of water vapor in the atmosphere accelerates beneficial processes. This includes an increase in the proportion of hydrogen in the pyrolysis gas and a reduction in the rate of $NO_x$ or $SO_2$ formation.

These findings further demonstrate that fuel additives according to the present disclosure may be economically justified—e.g., use of a fuel additive, as described herein, leads to a reduction in fuel consumption by minimizing unburned carbon loss. Additionally, it decreases $NO_x$ and $SO_2$ emissions during combustion, allowing for improved retention of nitrogen and sulfur in the coke, thus mitigating environmental concerns associated with processes like torrefaction or gasification.

Example 2: Evaluation of an Exemplary Waste-Derived Fuel Additive Using U.S. Bituminous and Sub-Bituminous Coal This study evaluated the performance of two different fuel additives according to the present disclosure. Each fuel additive was mixed with a respective sample of a sub-bituminous or bituminous coal. Sub-bituminous and bituminous rank coals provide most of the fuels US coal-fired utilities utilize for power generation. Less than 10% of electricity currently produced by coal-fired utilities is fueled by lignite and anthracite.

Materials and Methods

The composition of the first and second fuel additives are described above in Tables 1 and 2, respectively. The Sub-bituminous and bituminous coal samples used in this study were randomly selected and analyzed for proximate, ultimate, and ash minerals. The analyses of the sub-bituminous coal sample in Table 3 were typical of "Sub-bituminous C-rank" coal. The analyses of the bituminous coal sample in Table 4 were typical of "High Volatile Bituminous C-rank" coal.

TABLE 3

A proximate and ultimate analysis of the sub-bituminous coal sample used in this example.

| | As-Received Basis | Dry Basis |
|---|---|---|
| Proximate (%) | | |
| Moisture | 26.82 | 0 |
| Ash | 5.54 | 7.57 |
| Volatile | 31.09 | 42.48 |
| Fixed C | 36.55 | 49.95 |
| Total | 100 | 100 |
| Btu/lb (HHV) | 8457 | 11556 |
| Btu/lb (LHV) | 7849 | 11102 |
| MMF Btu/lb | 8995 | 12591 |
| MAF Btu/lb | 12502 | |
| Ultimate (%) | | |
| Moisture | 26.82 | 0 |
| Carbon | 49.82 | 68.07 |
| Hydrogen | 3.58 | 4.89 |
| Nitrogen | 0.71 | 0.97 |
| Sulfur | 0.226 | 0.309 |
| Ash | 5.54 | 7.57 |
| Oxygen* | 13.3 | 18.19 |
| Total | 100 | 100 |

TABLE 4

A proximate and ultimate analysis of the bituminous coal sample used in this example.

| | As-Received Basis | Dry Basis |
|---|---|---|
| Proximate (%) | | |
| Moisture | 6.2 | 0 |
| Ash | 5.1 | 5.43 |
| Volatile | 40.69 | 43.38 |
| Fixed C | 48.01 | 51.19 |
| Total | 100 | 100 |
| Btu/lb (HHV) | 10418 | 11107 |
| Btu/lb (LHV) | 9973 | 10700 |
| MMF Btu/lb | 11028 | 11804 |
| MAF Btu/lb | 11745 | |
| Ultimate (%) | | |
| Moisture | 6.2 | 0 |
| Carbon | 63.27 | 67.45 |
| Hydrogen | 4.12 | 4.39 |
| Nitrogen | 0.92 | 0.98 |
| Sulfur | 0.236 | 0.252 |
| Ash | 5.1 | 5.43 |
| Oxygen (by diff) | 20.15 | 21.5 |
| Total | 100 | 100 |

Samples of sub-bituminous coal obtained from the Powder River Basin (PRB), Wyoming, USA and higher-rank bituminous coal were tested separately and mixed with a first fuel additive and a second fuel additive, respectively, in each case at a concentration of 1 wt % (dry basis).

Results

A Netzsch Model STA 449 F3 Jupiter TGA/DSC Analyzer provided the TG (Thermogravimetric) and DSC (Differential Scanning calorimeter) analysis. Test parameters include a 20° C./min heating rate between 25° C. and 1000° C., 42 mL/min air atmosphere gas flow rate, and 8 mL/min $N_2$ purge gas flow rate. The use of air provided atmospheric combustion conditions. The analyzer required a minor flow of nitrogen gas to protect the balance and gas inlet apparatus from exothermic reactions.

TGA/DSC results are presented in FIGS. 10-17. As evidenced by these figures, the addition of 1 wt % of the first and second fuel additives, to sub-bituminous and bituminous coal, respectively, increased oxidation rate (weight loss) and heat flow.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular compound, composition, article, apparatus, methodology, protocol, and/or reagent, etc., described herein, unless expressly stated as such. In addition, those of ordinary skill in the art will recognize that certain changes, modifications, permutations, alterations, additions, subtractions and sub-combinations thereof can be made in accordance with the teachings herein without departing from the spirit of the present specification. It is therefore intended that the following appended claims and claims hereafter introduced are interpreted to include all such changes, modifications, permutations, alterations, additions, subtractions and sub-combinations as are within their true spirit and scope.

Certain aspects of the present disclosure are described herein, including the best mode known to the inventors for carrying out the disclosure. Of course, variations on these described embodiments will become apparent to those of ordinary skill in the art upon reading the foregoing description. The inventor expects skilled artisans to employ such variations as appropriate, and the inventors intend for the present disclosure to be practiced otherwise than specifically described herein. Accordingly, this disclosure includes all modifications and equivalents of the subject matter recited in the claims appended hereto as permitted by applicable law. Moreover, any combination of the above-described embodiments in all possible variations thereof is encompassed by the disclosure unless otherwise indicated herein or otherwise clearly contradicted by context.

Groupings of alternative embodiments, elements, or steps of the present disclosure are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

Notwithstanding that the numerical ranges and values setting forth the broad scope of the disclosure are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

The terms "a," "an," "the" and similar references used in the context of describing aspects of the present disclosure (especially in the context of the following claims) are to be construed to cover both the singular and the plural, unless otherwise indicated herein or clearly contradicted by context. Further, ordinal indicators-such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or "exemplary" language (e.g., "such as") provided herein is intended merely to better illuminate the present disclosure and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising" (and equivalent open-ended transitional phrases thereof like including, containing and having) encompasses all the expressly recited elements, limitations, steps and/or features alone or in combination with unrecited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amended for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (and equivalent open-ended transitional phrases thereof) includes within its meaning, as a limiting case, claimed subject matter specified by the closed-ended transitional phrases "consisting of" or "consisting essentially of." As such embodiments described herein or so claimed with the phrase "comprising" are expressly or inherently unambiguously described, enabled and supported herein for the phrases "consisting essentially of" and "consisting of."

All patents, patent publications, and other publications referenced and identified in the present specification are individually and expressly incorporated herein by reference in their entirety for the purpose of describing and disclosing, for example, the compositions and methodologies described in such publications that might be used in connection with the present disclosure. These publications are provided solely for their disclosure prior to the filing date of the present application. Nothing in this regard should be construed as an admission that the inventors are not entitled to antedate such disclosure by virtue of prior disclosure or for any other reason. All statements as to the date or representation as to the contents of these documents is based on the information available to the applicants and does not constitute any admission as to the correctness of the dates or contents of these documents.

Lastly, the terminology used herein is for the purpose of describing particular embodiments only, and is not intended to limit the scope of the present invention, which is defined solely by the claims. Accordingly, the present invention is not limited to that precisely as shown and described.

What is claimed is:

1. A fuel additive comprising industrial waste components, including bauxite residue, oil shale ash, calcium hydroxide, and cryolite.

2. The fuel additive according to claim 1, further comprising one or more secondary components selected from one or more metal chlorides, one or more metal hydroxides, one or more metal oxides, or a combination thereof.

3. The fuel additive according to claim 1, wherein the fuel additive further comprises Fe, $Fe_2O_3$, FeO, Zn, ZnO, Al, $Al_2O_3$, Ca, CaO, NaCl (0%-33%), $SiO_2$ (9.6%-47.4%), MgO (5.3%-14.9%), $Al(OH)_3$, BeO, $K_2O$, $Na_2O$ (0.4%-

12.1%), BaO, $MnO_2$, $Ba(OH)_2$ (2.3%-11.2%), $Cr_2O_3$, $Cr(OH)_3$, $ZnCl_2$ (6.2%-19.4%), $CaCl_2$), or any combination thereof; wherein the percentage of each component is measured as a wt. % based on the total weight of the fuel additive.

4. The fuel additive according to claim 1, wherein the fuel additive is provided as a powder.

5. The fuel additive according to claim 1, wherein the fuel additive has a moisture content of no more than about 10%.

6. A fuel briquette comprising:

the fuel additive according to claim 1, and a solid fuel.

7. The fuel briquette according to claim 6, wherein the solid fuel comprises coal, peat, wood, sawdust, and/or biomass.

8. The fuel briquette according to claim 6, wherein the briquette comprises the fuel additive in amount between about 0.5 and 3% by mass.

9. A method of making a fuel additive comprising:

providing industrial waste components, including bauxite residue, oil shale ash, calcium hydroxide, and cryolite, and combining the industrial waste components with one or more secondary components.

10. The method according to claim 9, wherein the one or more secondary components are selected from one or more metal chlorides, one or more metal hydroxides, one or more metal oxides, or a combination thereof.

11. The method according to claim 9, further comprising a drying step such that the fuel additive has a moisture content of no more than about 10%.

12. The method according to claim 9, further comprising a grinding step to provide a fuel additive in the form of a powder.

13. A method of using a fuel additive comprising:

combining a fuel additive with a fuel, and performing a process to generate energy from the fuel, wherein the fuel additive comprises industrial waste components, including bauxite residue, oil shale ash, calcium hydroxide, and cryolite.

14. The method according to claim 13, wherein the fuel comprises coal, peat, wood, sawdust, and/or biomass.

15. The method according to claim 13, wherein the fuel additive is combined with the fuel in an amount between about 0.5 and 3% by mass.

16. The fuel additive according to claim 1, further comprising one or more secondary components selected from one or more metal hydroxides, one or more metal oxides, or a combination thereof; wherein the fuel additive does not contain any metal chlorides.

17. The method according to claim 9, wherein the one or more secondary components are selected from one or more metal hydroxides, one or more metal oxides, or a combination thereof; wherein the fuel additive does not contain any metal chlorides.

* * * * *